US011053938B2

(12) United States Patent
Kim et al.

(10) Patent No.: US 11,053,938 B2
(45) Date of Patent: Jul. 6, 2021

(54) SCROLL COMPRESSOR WITH OIL SEPARATOR

(71) Applicant: LG Electronics Inc., Seoul (KR)

(72) Inventors: Cheolhwan Kim, Seoul (KR); Taekyoung Kim, Seoul (KR); Kangwook Lee, Seoul (KR); Byeongchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 363 days.

(21) Appl. No.: 15/974,358

(22) Filed: May 8, 2018

(65) Prior Publication Data

US 2018/0328362 A1 Nov. 15, 2018

(30) Foreign Application Priority Data

May 12, 2017 (KR) ..... 10-2017-0059506

(51) Int. Cl.

| | |
|---|---|
| ***F04C 18/02*** | (2006.01) |
| ***F04C 29/02*** | (2006.01) |
| ***F04C 29/12*** | (2006.01) |
| ***F04C 29/04*** | (2006.01) |

(52) U.S. Cl.

CPC ..... *F04C 18/0215* (2013.01); *F04C 29/026* (2013.01); *F04C 29/028* (2013.01); *F04C 29/12* (2013.01); *F04C 29/045* (2013.01)

(58) Field of Classification Search

CPC ..... F04C 29/026; F04C 29/028

See application file for complete search history.

(56) References Cited

U.S. PATENT DOCUMENTS

| | | | | |
|---|---|---|---|---|
| 4,717,316 | A | 1/1988 | Muramatsu et al. | |
| 4,762,471 | A * | 8/1988 | Asanuma | F04C 29/026 417/372 |
| 5,520,526 | A * | 5/1996 | Fujio | F04C 29/02 418/55.4 |

FOREIGN PATENT DOCUMENTS

| | | | |
|---|---|---|---|
| CN | 104728119 | | 6/2015 |
| JP | 62-147082 | A | 7/1987 |
| JP | 05-001683 | A | 1/1993 |
| JP | 19931683 | | 1/1993 |
| JP | 2007205270 | | 8/2007 |
| JP | 2007-315366 | A | 12/2007 |

(Continued)

OTHER PUBLICATIONS

European Search Report in European Application No. 18171826.3, dated Oct. 9, 2018, 8 pages.

*Primary Examiner* — Mary Davis

(74) *Attorney, Agent, or Firm* — Fish & Richardson P.C.

(57) ABSTRACT

Provided a scroll compressor including: a casing, an internal space in which is sealed; a drive motor that is configured with a stator which is located in the internal space, and a rotator which rotates within the stator, and that has an internal flow passage and an external flow passage that passes through the drive motor itself; a rotation shaft that is connected to the rotator of the drive motor; a compression unit that includes a first scroll which is provided below the drive motor, and a second scroll which is engaged with the first scroll; a discharge pipe that communicates with an upper space of the internal space, which is formed above to the drive motor; and an oil separation member that is provided between the drive motor and the discharge pipe, and from whose upper surface a space is formed to a predetermined depth.

19 Claims, 12 Drawing Sheets

(56) References Cited

FOREIGN PATENT DOCUMENTS

| | | | |
|---|---|---|---|
| KR | 10-0795956 | B1 | 1/2008 |
| KR | 10-2016-0017993 | A | 2/2016 |

* cited by examiner

SCROLL COMPRESSOR WITH OIL SEPARATOR

CROSS-REFERENCE TO RELATED APPLICATION

Pursuant to 35 U.S.C. § 119(a), this application claims the benefit of earlier filing date and right of priority to Korean Application No. 10-2017-0059506, filed on May 12, 2017, the contents of which are incorporated by reference herein in its entirety.

BACKGROUND OF THE DISCLOSURE

1. Field of the Disclosure

The present disclosure relates to a scroll compressor, and particularly to a compressor in which a compression unit is positioned to one side of an electric motor.

2. Background of the Disclosure

A scroll compressor is a compressor in which, while an orbiting motion is performed with multiple scrolls being engaged with each other, a compression chamber which includes an absorption chamber, an intermediate pressure chamber, and a discharge chamber are formed between both scrolls. This type of scroll compressor achieves not only a comparatively high compression when compared with other types of compressor, but also a stable torque due to smooth strokes for refrigerant absorption, compression, and discharge. Therefore, the scroll compressor is widely used for refrigerant compression in an air conditioning apparatus and the like. In recent years, scroll compressors have been introduced in which an eccentric load is reduced, resulting in an operating speed of 180 Hz or higher.

The scroll compressors are categorized into low-pressure compressors in which an absorption pipe communicates with an internal space in a case, which serves as a low-pressure portion, and high-pressure compressors in which the absorption pipe communicates directly with a compression chamber. Thus, in the high-pressure compressor, a drive unit is installed in an absorption space that serves as the low-pressure portion, but in the low-pressure compressor, the drive is installed in a discharge space that serves as a high-pressure portion.

These types of scroll compressors are categorized into upper compression types of scroll compressors and lower compression types of scroll compressors according to positions of the drive unit and a compression unit. In the upper compression type of scroll compressor, the compression unit is positioned more upward than the drive unit, but in the lower compression type of scroll compressor, the compressor unit is positioned more downward than the drive unit.

Normally, in compressors that include a high-pressure type of scroll compressor, a discharge pipe is positioned far away from the compression unit in such a manner that oil is separated from a refrigerant in the internal space in the casing. Therefore, in the high-pressure type of scroll compressor that belongs to the upper compression type of scroll compressor, the discharge pipe is positioned between an electric motor and the compression unit, but the high-pressure type of scroll compressor that belongs to the lower compression type of scroll compressor, the discharge pipe is positioned over the electric motor.

Thus, in the upper compression type of scroll compressor, the refrigerant that is discharged from the compression unit flows from an intermediate space between the electric motor and the compression unit toward the discharge pipe, without flowing up to the electric motor. On the other hand, in the lower compression type of scroll compressor, the refrigerant that is discharged from the compression unit passes through the electric motor, and then flows from an oil separation space, which is formed over the electric motor, toward to the discharge pipe.

At this time, oil that is separated from the refrigerant in an upper space that serves as the separation space passes through the electric motor, and then flows into an oil storage space that is formed under the compression unit. The refrigerant that is discharged from the compression unit passes through the electric motor as well and flows toward the oil separation space.

In the lower compressor type of scroll compressor in the related art, as described above, while the refrigerant and the oil, which are discharged from the compression unit and flows into the upper space, circulates through the upper space, the oil is separated from the refrigerant, the refrigerant from which the oil is separated is driven out of the outside of the compressor through the discharge pipe, and the oil collects in the lower space. However, the oil that flows into the upper space is not sufficiently separated from the refrigerant, and thus the oil is driven out of the compressor, along with the refrigerant. As a result, there is a problem in that an increasing oil shortage in the compressor is caused.

Furthermore, in the lower compressor type of scroll compressor in the related art, in a case where an inverter motor in which an operation speed of the electric motor is variable is used, the degree of the oil separation is not constant. There is a problem in that this inconstancy decreases the reliability of the compressor. That is, in a case where the electric motor operates in a high speed (approximately 90 Hz or higher in the case of the compressor) or low speed (approximately 40 to 50 Hz or lower in the case of the compressor), while the refrigerant and the oil that are discharged from the compressor pass through the electric motor and flows into the upper space, an oil separation effect may be achieved to some degree by centrifugal force. However, the dependence on the centrifugal force caused by the rotator makes a satisfactory oil separation effect difficult to expect. In a case where the electric motor operates at an intermediate speed (approximately 60 to 90 Hz in the case of the compressor), there is a limitation in that, characteristically, the oil separation effect that results from the centrifugal force is more decreased.

Furthermore, in the lower compression type of scroll compressor in the related art, a refrigerant discharge path and an oil collection path run in opposite directions and thus interfere with each other. Thus, the refrigerant and the oil cause flow passage resistance. Particularly, the oil does not collect into the oil storage space due to the high-pressure refrigerant. This causes an oil shortage within the casing. Thus, frictional loss or abrasion occurs due to the oil shortage in the compression unit.

Furthermore, as in the lower compression type of scroll compressor in the related art, when the refrigerant discharge path and the oil collection path interfere with each other, the oil that is separated from the refrigerant in the internal space in the casing is mixed again with the refrigerant that is discharged and is discharged to the outside of the compressor. Thus, there occurs a problem in that the oil shortage within a severe compression continues.

Furthermore, the lower compression type of scroll compressor in the related art, an oil collection flow passage along which the oil that collects between the electric motor and the compression unit flows into the lower space in the casing is sufficiently secured. Thus, the oil stays over the compression unit. This increases a likelihood that the oil that is mixed with the refrigerant will flow into the upper space and will be then discharged to the outside of the compressor. As a result, a severer oil shortage within the compressor continues.

SUMMARY OF THE DISCLOSURE

Therefore, an aspect of the detailed description is to provide a scroll compressor that is capable of separating refrigerant and oil within a casing and of minimizing the driving of the oil out of the casing along with the refrigerant.

Another object of the present invention is to provide a scroll compressor that is capable of being less influenced by an operation speed of an electric motor and thus increasing an oil separation effect in all operation bands.

Still another object of the present invention is to provide a scroll compressor in which oil that is separated from refrigerant in an upper space in a casing flows smoothly into a lower space in the casing.

Still another object of the present invention is to provide a scroll compressor in which oil that is separated from refrigerant in an upper space in a casing is prevented in advance from being mixed with refrigerant that flows from a lower space toward the upper space in the casing.

Still another object of the present invention is to provide a scroll compressor in which oil that collects between an electric motor and a compression unit collects into a lower space in a casing without being mixed with refrigerant that is discharged from the compression unit.

Still another object of the present invention is to provide a scroll compressor of which an oil separation unit is stably supported on a member that supports the oil separation unit and thus which ensures high reliability and suppresses vibration and nose due to the oil separation unit.

Still another object of the present invention is to provide a scroll compressor of which an oil separation unit is suppressed from being separated from a member that supports the oil separation unit and the number of whose assembling components is reduced to save the man-hour assembling costs.

Still another object of the present invention is to provide a scroll compressor in which a refrigerant flow passage and an oil flow passage are reliably separated within a casing.

To achieve these and other advantages and in accordance with the purpose of this specification, as embodied and broadly described herein, there is provided a scroll compressor including: a casing that has an internal space; an electric motor that includes a stator which is provided win the internal space and is connected to the casing, and a rotator which is rotatably provided within the stator; a compression unit that is provided below the electric motor; a rotation shaft that transfers drive force from the electric motor to the compression unit; and an oil separation member that is provided above the electric motor and that increases inertia of oil and thus separates oil from refrigerant by increased inertia.

In the scroll compressor, a space in the shape of a truncated cup may be formed to a predetermined depth from an upper surface of the separation member.

The scroll compressor may further a flow passage separation unit that is installed between the electric motor and the compression unit, and separates a refrigerant flow passage and an oil flow passage.

In the scroll compressor, the flow passage separation unit may be formed with a first flow passage guide that is connected to the compression unit and a second flow passage guide that extends from the electric motor, the second flow passage guide may be configured with an insulator that is provided in the electric motor, and an oil sealing member may be further provided between the first flow passage guide and the second flow passage guide.

To achieve these and other advantages and in accordance with the purpose of this specification, as embodied and broadly described herein, there is provided a scroll compressor including: a casing, an internal space in which is sealed; a drive motor that is configured with a stator which is located in the internal space in the casing, and a rotator which rotates within the stator, and that has an internal flow passage and an external flow passage that passes through the drive motor itself in an axial direction; a rotation shaft that is connected to the rotator of the drive motor and thus rotates; a compression unit that includes a first scroll which is provided below the drive motor, and a second scroll which is engaged with the first scroll to form a compression chamber while the second scroll performs an orbiting motion with respect to the first scroll, refrigerant that is compressed in the compression chamber is discharged toward the internal space in the casing; a discharge pipe that communicates with an upper space of the internal space in the casing, which is formed above the drive motor; and an oil separation member that is provided between the drive motor and the discharge pipe, and from whose upper surface a space is formed to a predetermined depth in such a manner that oil is separated by a centrifugal force from refrigerant that is discharged from the compression unit.

In the scroll compressor, the space may be formed in such a manner that an inside diameter is greater than an outside diameter of the discharge pipe and that an end portion of the discharge pipe is inserted into the space.

In the scroll compressor, the oil separation member may be configured with a bottom portion that is provided on an end portion of the rotator or on an end portion of a member that is connected to the rotator, and of which an upper surface is positioned at a distance away from the discharge pipe, and a side-wall portion that protrudes from an edge of the bottom portion in the axial direction up to a height that overlaps the discharge pipe, thereby forming the space.

In the scroll compressor, a balance weight may be connected to the rotator, and the oil separation member may be connected to an upper surface of the balance weight, or may be integrally formed with the upper surface of the balance weight into a single body.

In the scroll compressor, a stationary portion that is inserted into the balance weight in such a manner as to be supported in the radial direction may be formed on the bottom portion of the oil separation member.

In the scroll compressor, the side-wall portion may be formed in such a manner that a height of the side-wall portion is equal to or greater than a distance between an upper surface of the bottom portion and a lower end of the discharge pipe.

In the scroll compressor, the side-wall portion may be formed so slantly that the more closely an upper end of the side-wall portion is approached, the greater an inside diameter of the side-wall portion.

In the scroll compressor, the side-wall portion may be formed to be stepped in such a manner that an inside diameter of an upper end of the side-wall portion is more enlarged than an inside diameter of a lower end of the side-wall portion.

In the scroll compressor, the space may be formed in such a manner that the center of the space is on the same axis as the center of the discharge pipe.

In the scroll compressor, a mesh or an oil separation plate may be further provided an inlet end of the discharge pipe.

The scroll compressor may further include a flow passage separation unit that is formed into the shape of a ring between the drive motor and the compression unit, and separates a space between the drive motor and a frame into an internal space that communicates with the internal flow passage in the drive motor and an external space that communicates with the external flow passage of the drive unit.

To achieve these and other advantages and in accordance with the purpose of this specification, as embodied and broadly described herein, there is provided a scroll compressor including: an electric motor that includes a stator and a rotator; a rotation shaft that is connected to the rotator; a compression unit in which multiple scrolls are engaged with each other for combination of the multiple scrolls, the rotation shaft passes through the multiple scrolls for the combination of the multiple scrolls, a rotation force of the electric motor is transferred to one of the multiple scrolls through the rotation shaft, and fluid is compressed while the one scroll performs an orbiting motion with respect to the other scrolls; a casing that accommodates the electric motor and the compression unit, and has a first space between the electric motor that is positioned above the compression unit and the compression unit that is positioned below the electric motor, has a second space, with which a discharge pipe communicates, above the electric motor, and has a third space, in which an oil feeder that extends from the rotation shaft which passes through the compression unit is accommodated, below the compression unit; and an oil separation member that is provided in the second space and is connected to the rotator or the rotation shaft, and from whose upper surface a space is formed to a predetermined depth.

In the scroll compressor, a discharge pipe that passes through the casing may be connected to the second space in such a manner as to communicate with the second space, and the discharge pipe may be inserted into the space in such a manner as to overlap the space in the oil separation member in the axial direction.

In the scroll compressor, a flow passage guide, which separates a space between the electric motor and the compression unit into multiple spaces along the radial direction, may be further included between the electric motor and the compression unit.

To achieve these and other advantages and in accordance with the purpose of this specification, as embodied and broadly described, there is provided scroll compressor including: a casing; a drive motor that is provided in an internal space in the casing, a compression unit that is connected to the drive motor and compresses refrigerant while rotating: a discharge pipe that communicates with an upper space in the casing, which is formed above the drive motor, and discharges the refrigerant from the compression unit into the internal space in the casing; and an oil separation member from whose upper surface a space is formed to a predetermined depth, which is provided on a rotator of the drive motor or the rotation shaft, and which rotates along with the rotator or the rotation shaft in such a manner that the refrigerant and oil are separated by a centrifugal force from each other in the space.

In the scroll compressor, the oil separation member may be configured with a bottom portion that extends toward an inner circumferential surface of the casing, and is positioned at a distance away from a lower end of the discharge pipe; and a side-wall portion that protrudes upward from an edge of the bottom portion in an axial direction to form the space that takes the shape of a ring.

In the scroll compressor, a lower end of the discharge pipe may be inserted into the space, and a lower end of the discharge pipe may overlap the side-wall portion in the axial direction.

In the scroll compressor, an oil separation plate that takes the shape of a mesh or a ring may be further provided on the lower end of the discharge pipe.

In the scroll compressor, a flow passage guide, which separates a space between the electric motor and the compression unit into multiple spaces along the radial direction, may be further included between the electric motor and the compression unit.

In a scroll compressor according to a present invention, an oil separation member that including a space is installed on a rotator or an upper end of the rotator, and thus oil that, along with refrigerant, stays in the space has more inertia while rotating along with a rotator or the rotation shaft. As a result, the oil is effectively by the inertia from the refrigerant, and thus frictional loss or abrasion due to an oil shortage within the compressor can be prevented in advance even during a low- or high-speed operation.

Furthermore, in the scroll compressor according to the present invention, in addition to an oil separation member, a mesh or an oil separation plate is further provided on an inlet end of a discharge pipe, and thus oil is separated from refrigerant by a filtration technique or a precipitation technique, as well as a centrifugal separation technique. As a result, an oil separation effect can be improved even during a low- or high-speed operation.

Furthermore, in the scroll compressor according to the present invention, a refrigerant flow passage and an oil flow passage are separated in an internal space in a casing. Thus, while the oil that is separated from the refrigerant in an upper space in the case collects in a lower space on the casing, the oil can be prevented from being re-mixed with the refrigerant.

Furthermore, in the scroll compressor according to the present invention, an oil separation unit is supported in a radial direction on a member that supports the oil separation unit, and thus the oil separation is stably located. This increase reliability and suppresses vibration and noise due to the oil separation unit.

Furthermore, in the scroll compressor according to the present invention, the oil separation unit is formed with a member that supports the oil separation unit, into a single body, and thus a force to support the oil separation unit is increased, and the number of assembling components and the man-hour assembling costs can be reduced.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure. In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

A scroll compressor according to an embodiment of the present invention will be described in detail below with reference to the accompanying drawing. For reference and convenience, as a typical example of the embodiment of the scroll compressor according to the present invention, a type of scroll compressor in which a rotation shaft overlaps a volute wrap in the same plane will be described, among lower compression types of scroll compressors in which a compression unit is positioned more downward than an electric motor. It is known that this type of scroll compressor is suitable for application in a cooling cycle system under the condition of a high pressure ratio at high-temperature.

Figure 1:
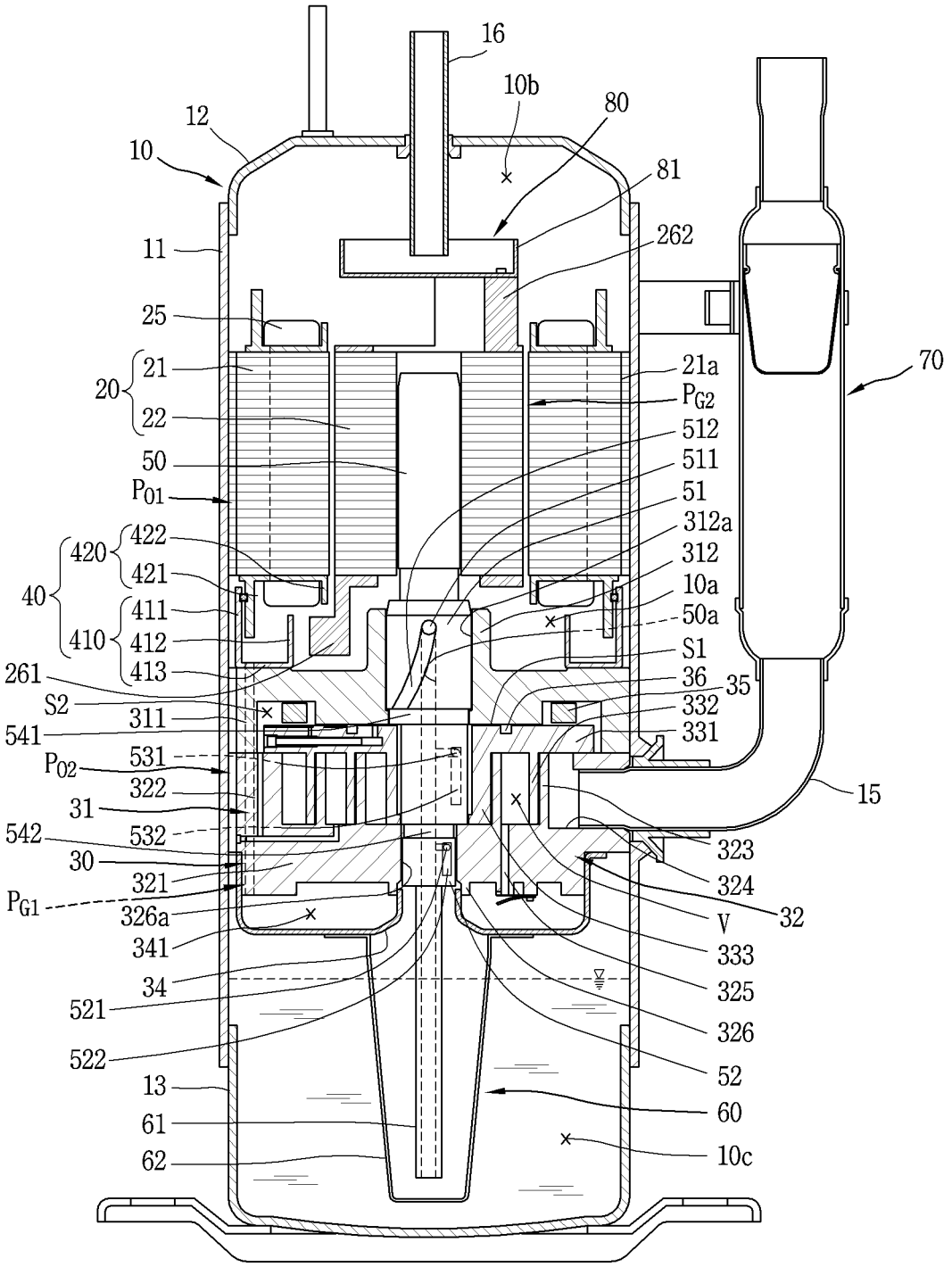
FIG. 1 is a vertical cross-sectional diagram illustrating a lower compression type of scroll compressor according to the present invention.
Figure 2:
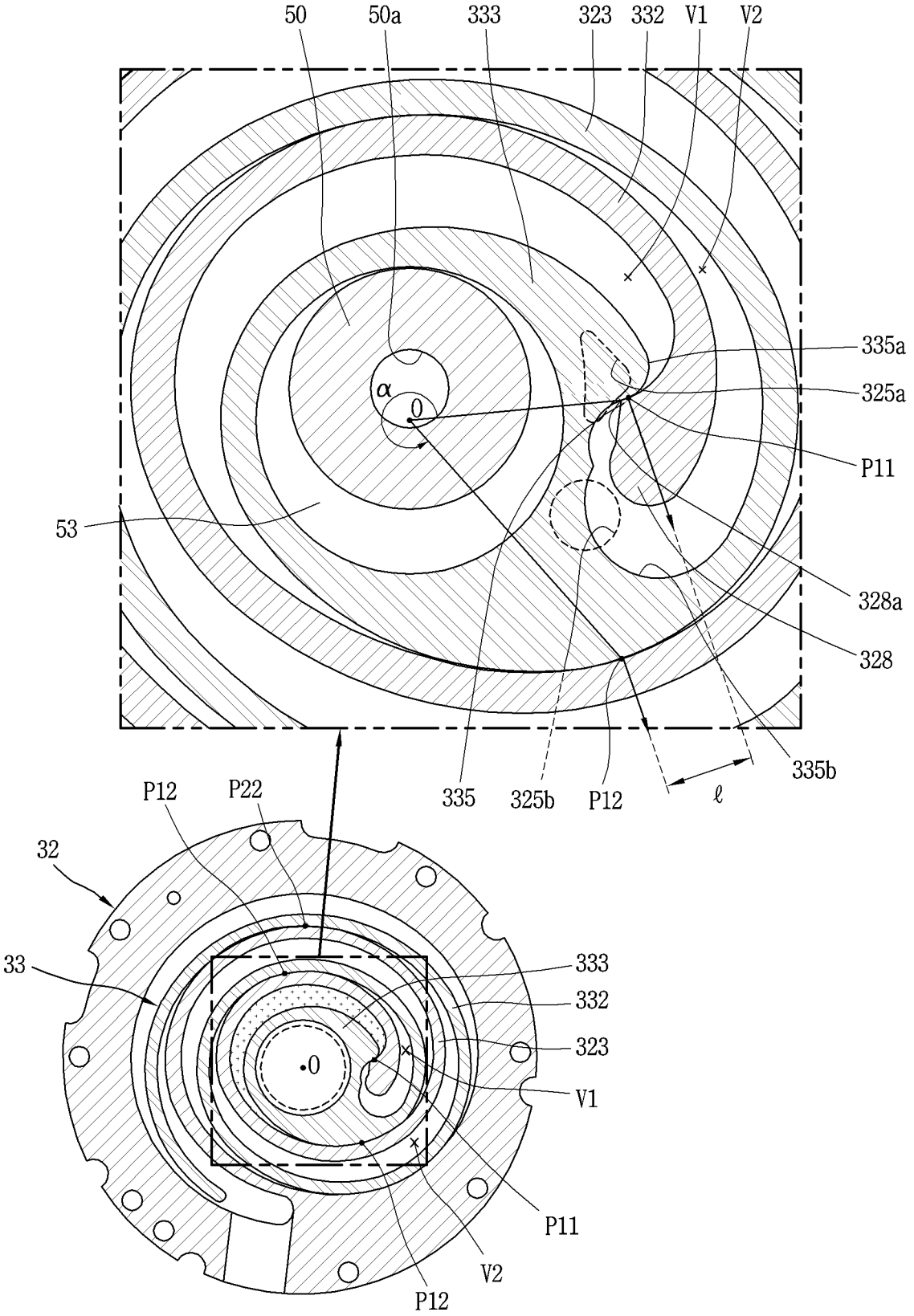
FIG. 2 is a horizontal cross-sectional diagram illustrating a compression unit in FIG. 1.
Figure 3:
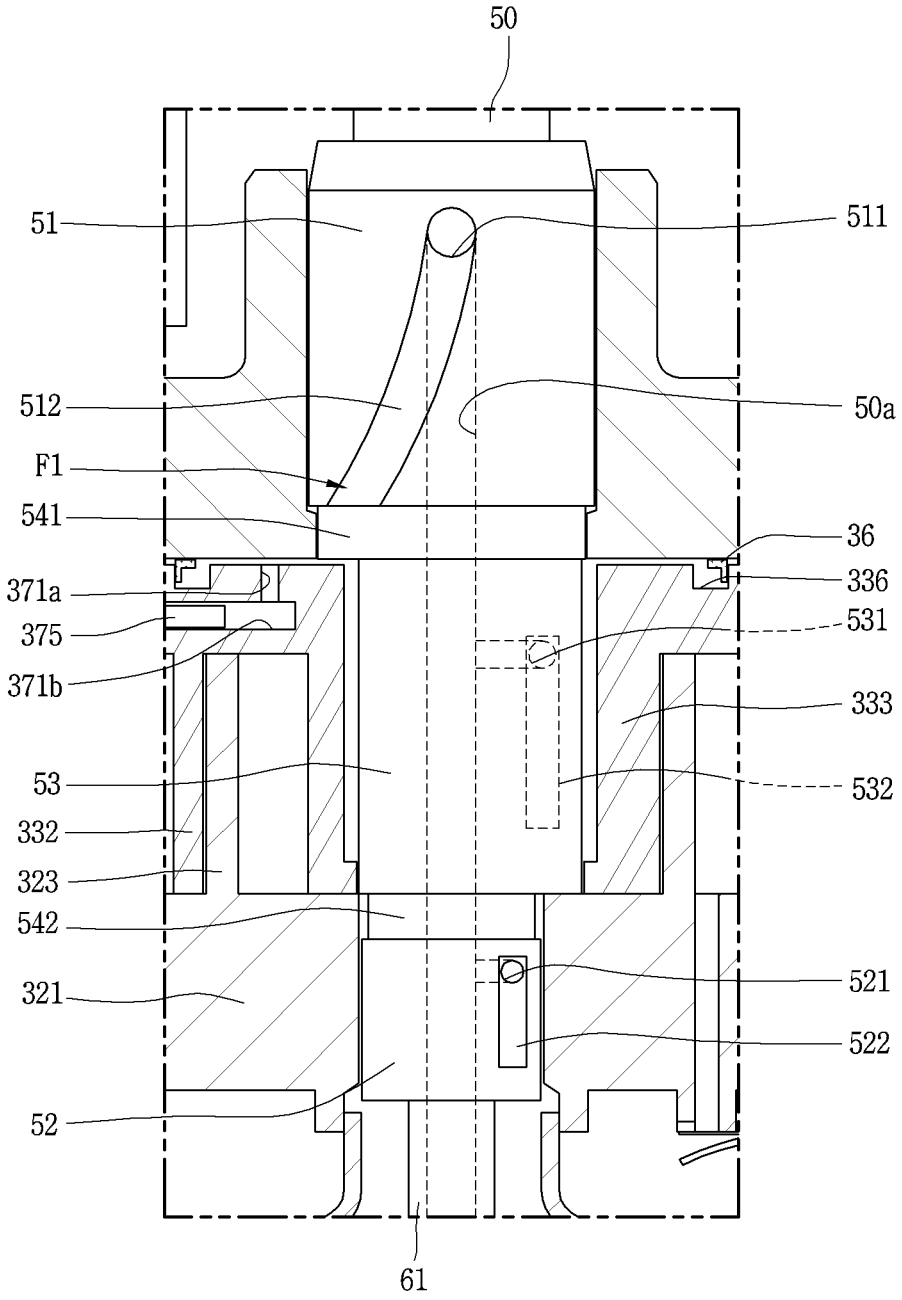
FIG. 3 is a front-view diagram illustrating a portion of a rotation shaft for describing a sliding member in FIG. 1.
Figure 4:
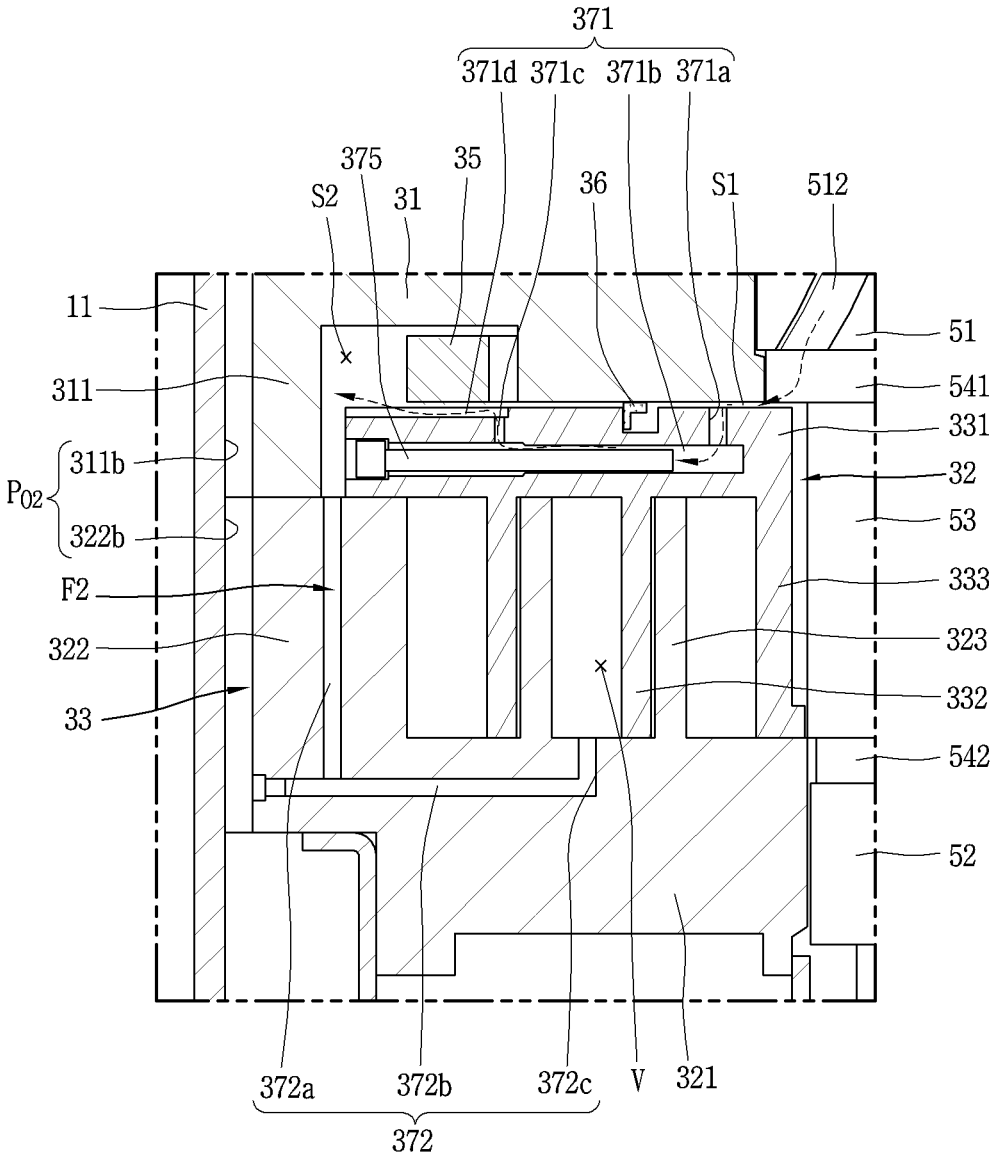
FIG. 4 is a vertical cross-sectional diagram for describing an oil supply path between a backpressure chamber and a compression chamber in FIG. 1.

FIG. 1 is a vertical cross-sectional diagram illustrating a lower compression type of scroll compressor according to the present invention. FIG. 2 is a horizontal cross-sectional diagram for describing a sliding member in FIG. 1, illustrating a compression unit in FIG. 1. FIG. 3 is a front-view diagram illustrating a portion of a rotation shaft. FIG. 4 is a vertical cross-sectional diagram for describing an oil supply path between a backpressure chamber and a compression chamber.

With reference to FIG. 1, a lower compression type of scroll compressor according to the present embodiment includes an electric motor 20 and a compression unit 30 within a casing 10. The electric motor 20 serves as a drive motor and generates rotary force. The compression unit 30 is installed under the electric motor 20 between a prescribed space (hereinafter referred to as an intermediate space) 10*a*. The compression unit 30 is provided with the rotary force of the electric motor 20 and compresses a refrigerant.

The casing 10 is configured to include a cylindrical shell 11 that makes up a sealed receptacle, an upper shell 12 that covers an upper portion of the cylindrical shell 11 to make up the sealed receptacle along with the cylindrical shell 11, and a lower shell 13 that makes up the sealed receptacle along with the cylindrical shell 11 and, at the same time, forms an oil storage space 10*c*.

A refrigerant absorption pipe 15 passes through a flank surface of the cylindrical shell 11 and communicates directly with an absorption chamber of the compression unit 30. A refrigerant discharge pipe 16 that communicates with an upper space 10*b* in the casing 10 is installed in an upper portion of the upper shell 12. The refrigerant discharge pipe 16A corresponds to a path along which a compressed refrigerant that is discharged from the compression unit 30 to the upper space 10*b* in the casing 10 is exhausted to the outside. The refrigerant discharge pipe 16 is inserted into up to the middle of the upper space 10*b* in the casing 10 in such a manner that a type of oil separation space is formed in the upper space 10*b*. Then, whenever necessary, an oil separator (not illustrated) that separates oil from an oil-mixed refrigerant may be installed within the casing 10 including the upper space 10*b*, or within the upper space 10*b*, in a manner that is connected to the refrigerant absorption pipe 15.

The electric motor 20 is configured with a stator 21 and a rotator 22 that rotates within the stator 21. Teeth and slots that make up multiple coil winding portions (each of which has a reference numeral) are formed along a circumferential direction on an inner circumferential surface of a stator 21, and a coil 25 is wound around the stator 21. A second refrigerant flow passage PG2 is formed that results from combining a gap between the inner circumferential surface of the stator 21 and an outer circumferential surface of a rotator 22 and the coil winding portions. Accordingly, the refrigerant, which is discharged to the intermediate space 10*c* between the electric motor 20 and the compression unit 30 through a first refrigerant flow passage PG1 that will be described above, moves to the upper space 10*b* that is formed above the electric motor 20, through the second refrigerant flow passage PG2 that is formed in the electric motor 20.

Then, multiple D-cut surfaces are formed along the circumferential direction on an outer circumferential surface of the stator 21. A first oil flow passage PO1 is formed on the D-cut surface 21*a* in such a manner that oil passes between the D-cut surface 21*a* itself and an inner circumferential surface of the cylindrical shell 11. Accordingly, the oil, which is separated from the refrigerant, moves to a lower space 10*c* through the first oil flow passage PO1 and through a second oil flow passage PO2 that will be described below.

A frame 31, which serves as the compression unit 30 with a prescribed gap between the frame 31 itself and the stator 21, is connected fixedly with the inner circumferential surface of the casing 10 under the stator 21. The frame 31 is fixedly connected to the inner circumferential surface of the cylindrical shell 11 using a shrink fitting method or a welding manner.

Then, a frame side-wall portion (a first side-wall portion) 311 that takes the shape of a ring is formed on an edge of the frame 31. Multiple communicating grooves 311*b* are formed along the circumferential direction in an outer circumferential surface of the first side-wall portion 311. The communicating groove 311*b*, along with a communicating groove 322*b* in a first scroll 32 that will be described above, forms the second oil flow passage PO2.

Furthermore, a first shaft bearing unit 312 for supporting a main bearing unit 51 of a rotation shaft 50 that will be described below is formed on the center of the frame 31. A first shaft bearing hole 312*a*, into which the main bearing unit 51 of the rotation shaft 50 is rotatably inserted for support in a radial direction, is formed in the first shaft bearing unit 312 to pass through the first shaft bearing unit 312 in an axial direction.

Then, a stationary scroll (hereinafter referred to as a first scroll) 32 is installed on a lower surface of the frame 31 with the lower surface itself of the frame 31 and an orbiting scroll (hereinafter referred to as a second scroll) 33 eccentrically connected to the rotation shaft 50 in between. The first scroll 32 may be connected to the frame 31 in a fixed manner, or may be connected to the frame 31 in a manner that is movable in the axial direction.

On the other hand, on the first scroll 32, a stationary disc portion (hereinafter referred to as a first disc portion) 321 is formed in approximately the shape of a circle. A scroll side-wall portion (hereinafter referred to as a second side-wall portion) 322, which is connected to an edge of a lower surface of the frame 31, is formed on an edge of the first disc portion 321.

An absorption inlet 324, through which the refrigerant absorption pipe 15 and the absorption chamber communicate with each other, is formed one side of the second side-wall portion 322 to pass through the one side of the second side-wall portion 322. Discharge outlets 325*a* and 325*b*, which communicate with a discharge chamber and through which the compressed refrigerant is discharged, are formed in a center portion of the first disc portion 321. One discharge outlet 325*a* or 325*b* may be formed in such a manner as to communicate with both a first compression chamber V1 and a second compression chamber V2, which will be described below, and multiple discharge outlets, that is, the discharge outlets 325*a* and 325*b* may be formed independently in such a manner as to communicate with the compression chambers V1 and V2, respectively.

Then, the communicating groove 322*b*, which is described above, is formed in an outer circumferential surface in the second side-wall portion 322. The communicating groove 322*b*, along with the communicating groove 311*b* in the first side-wall portion 311, forms the second oil flow passage PO2 for guiding oil that is collected, to the lower space 10*c*.

Furthermore, a discharge cover 34 for guiding a refrigerant that is discharged from the compression chamber V, to a refrigerant flow passage, which will be described below, is connected to a lower side of the first scroll 32. An internal space in the discharge cover 34 is formed in such a manner as to accommodate the discharge outlets 325*a* and 325*b*, and, at the same time, in such a manner as to accommodate an entrance to the first refrigerant flow passage PG1 that guides the refrigerant that is discharged from the compression chamber V through the discharge outlet 325*a* or 325*b*, to the upper space 10*b* in the casing 10, more precisely, to a space between the electric motor 20 and the compression unit 30.

At this point, the first refrigerant flow passage PG1 is formed to pass through the second side-wall portion 322 of the stationary scroll 32 and the first side-wall portion 311 of the frame 31, sequentially, starting from inside of a flow passage separation unit 40, that is, from the rotation shaft 50 that is positioned inward from the flow passage separation unit 40. Accordingly, the second oil flow passage PO2, which is described above, is formed outside of the flow passage separation unit 40 in such a manner as to communicate with the first oil flow passage PO1. The oil separation unit will be described in detail below.

A stationary wrap (hereinafter referred to as a first wrap) 323 is formed on an upper surface of the first disc portion 321. The stationary wrap intermeshes with an orbiting wrap (hereinafter referred to as a second wrap) 332, which will be described below, and thus makes up the compression chamber V. The first wrap 323 will be described below along with the second wrap 332.

Furthermore, a second shaft bearing unit 326, which supports a sub-bearing unit 52 of the rotation shaft 50, which will be described below, is formed on the center of the first disc portion 321. A second shaft bearing hole 326*a*, through which the sub-bearing unit 52 passes in the axial direction to be supported in the radial direction, is formed in the second shaft bearing unit 326.

On the other hand, an orbiting disc portion (hereinafter referred to as a second disc portion) 331 of the second scroll 33 is formed approximately in the shape of a disk. The second wrap 332, which intermeshes with the first wrap 322 and thus makes up the compression chamber, is formed on a lower surface of the second disc portion 331.

Along with the first wrap 323, the second wrap 332 may be formed in an involute shape, and may be formed in various shapes other than the involute shape. For example, as illustrated in FIG. 2, the second wrap 332 may take a shape in which multiple circular arcs that have different diameters and origins are connected to each other, and the outermost curved line is formed in the shape of approximately an ellipse that has a long axis and a short axis. The first wrap 323 may be formed in the same manner.

A rotation shaft combination portion 333, into which an eccentricity portion 53 of the rotation shaft 50 is rotatably inserted for combination, is formed in a center portion of the second disc portion 331 to pass through the center portion of the second disc portion 331 in the axial direction. The rotation shaft combination portion 333 is an internal end portion of the second wrap 332. The eccentricity portion 53 of the rotation shaft 50 will be described below.

An outer circumferential portion of the rotation shaft combination portion 333 is connected to the second wrap 332 and plays the role of forming the compression chamber V along with the first wrap 322 during a compression process.

Furthermore, the rotation shaft combination portion 333 is formed to such a height that rotation shaft combination portion 333 overlaps the second wrap 332 in the same plane, and thus the eccentricity portion 53 of the rotation shaft 50 is positioned at such a height that the eccentricity portion 53 overlaps the second wrap 332 in the same plane. When this is done, counterforce by the refrigerant and compression force against the refrigerant are applied to the same plane with respect to the second disc portion 331, and thus cancel each other out. As a result, the second scroll 33 can be prevented from being inclined due to the exertion of compression force and counterforce.

Furthermore, a recessed portion 335 that is engaged with a protruding portion 328 of the first wrap 323, which will be described below, is formed the outer circumferential portion of the rotation shaft combination portion 333 that faces an internal end portion of the first wrap 323. An increment portion 335*a* is formed on one side of the recessed portion 335. A thickness of the increment portion 335 increases over portions of the rotation shaft combination portion 333, starting with an inner circumferential portion thereof, ending with the outer circumferential portion thereof, upstream along a direction of forming the compression chamber V. This increases a compression path in the first compression chamber V1 immediately before discharge, and consequently, a compression ratio in the first compression chamber V1 is increased closely to a compression ratio in the second compression chamber V2. The first compression chamber V1, which is a compression chamber that is formed between an internal flank surface of the first wrap 323 and an external flank surface of the second wrap 332, will be described below separately from the second compression chamber V2.

A circular-arc compression surface 335*b* that takes the shape of a circular arc is formed on the other side of the recessed portion 335. A diameter of the circular-arc compression surface 335*b* is determined by an internal end portion thickness (that is, a thickness of a discharge end) of the first wrap 323 and an orbiting radius of the second wrap 332. When the internal end portion thickness of the first wrap 323 is increased, the diameter of the circular-arc compression surface 335*b* is increased. As a result, a thickness of the second wrap in the vicinity of the circular-arc compression surface 335*b* is increased, and the compression path is lengthened. The compression ratio in the second wrap V2 is increased as much as the compression path is lengthened.

Furthermore, the protruding portion 328, which protrudes from the outer circumferential portion side of the rotation shaft combination portion 333, is formed in the vicinity of an internal end portion (an absorption end or a start end) of the first wrap 323, which corresponds to the rotation shaft combination portion 333. A contact portion 328*a*, which protrudes from the protruding portion 328 and is engaged with the recessed portion 335, is formed on the protruding portion 328. That is, the internal end portion of the first wrap 323 is formed in such a manner that the internal end portion has a greater thickness than other portions. As a result, wrap strength of the internal end portion of the first warp 323, on which the largest compression force is exerted is improved, thereby increasing the durability.

On the other hand, the compression chamber V is formed between the first disc portion 321 and the first wrap 323, and between the second wrap 332 and the second disc portion 331, and is configured to include an absorption chamber, an intermediate pressure chamber, and a discharge chamber that are successively formed along a direction in which a wrap progresses.

As illustrated in FIG. 2, the compression chamber V is configured to include the first compression chamber V1 that is formed between the internal flank surface of the first wrap 323 and the external flank surface of the second wrap 332, and the second compression chamber V2 that is formed between an external flank surface of the first wrap 323 and an internal flank surface of the second wrap 332.

That is, the first compression chamber V1 includes a compression chamber that is formed between two contact points P11 and P12 which occur when the internal flank surface of the first wrap 323 and the external flank surface of the second wrap 332 are brought into contact with each other. The second compression chamber V2 includes a chamber that is formed between two contact points P21 and P22 which occur when the external flank surface of the first warp 323 and the internal flank surface of the second wrap 332 are brought into contact with each other.

At this point, when the greater of angles that the two contact points P11 and P12 that connect the center of the eccentricity portion 53, that is, the center O of the rotation shaft combination portion 333 and the two contact points P11 and P12, respectively, make with respect to each other is defined as having a value of $\alpha$, $\alpha<360°$ at least immediately before discharge start, and a distance I between normal vectors at the two contact points P11 andP12 has a value of 0 or greater.

For this reason, the first compression chamber immediately before the discharge has a smaller volume than is the case when the stationary wrap and the orbiting wrap that take the shape of an involute curve, and thus the compression ratio in the compression chamber V1 and the compression ratio in the compression chamber V2 are both improved without increasing sizes of the first wrap 323 and the second wrap 332.

On the other hand, as described above, the second scroll 33 is installed, in a manner that enables the second scroll 33 to orbit, between the frame 31 and the stationary scroll 32. Then, an Oldham ring 35 that prevents the second scroll 33 from rotating about its axis is installed between an upper surface of the second scroll 33 and a lower surface of the frame 31 that corresponds to the upper surface of the second scroll 33. A sealing member 36, which forms a backpressure chamber S1 that will be described below, is installed more inward than the Oldham ring 35.

Then, as a result of an oil supply hole 321*a* that is provided in the second scroll 32, an intermediate pressure space is formed outside of the sealing member 36. The intermediate pressure space communicates with the compression chamber V and, when filled with an intermediate-pressure refrigerant, plays the role of the backpressure chamber. Accordingly, the counterpressure chamber that is formed more inward than the sealing member 36 is defined as a backpressure chamber S1, the counterpressure chamber that is formed more outward than the sealing member 36 is defined as a second backpressure chamber S2. Consequently, the backpressure chamber S1 is a space that is formed by a lower surface the frame 31 and an upper surface of the second scroll 33 with the sealing member 36 in between. The backpressure chamber S1 will be again described below along with the sealing member.

On the other hand, the flow passage separation unit 40 is installed in the intermediate space 10*a* that is a passing-through space which is formed between a lower surface of the electric motor 20 and an upper surface of the compressor unit 30. The flow passage separation unit 40 plays the role of preventing the refrigerant that is discharged from the compressor unit 30 from interfering with the oil that flows from the upper space 10*b* of the electric motor 20, which is the oil separation space, into a lower space 10*c* in the compressor unit 30 that is the oil storage space.

To do this, the flow passage separation unit 40 according to the present embodiment includes a flow passage guide that separates the first space 10*a* into a space (hereinafter referred to as a refrigerant flow space) in which the refrigerant flows, and a space (hereinafter referred to as an oil flow space) in which the oil flows. Only with the flow passage guide itself, the first space 10*a* is separated into the refrigerant flow space and the oil flow space, but whenever necessary, a combination of multiple passage guides may play the role of the flow passage guide.

The flow passage separation unit 40 according to the present embodiment is configured with a first flow passage guide 410 that is provided on the frame 31 and extends upward, and a second flow passage guide 420 that is provided on the stator 21 and extends downward. The first flow passage guide 410 and the second flow passage guide 420 overlap in the axial direction, and thus the intermediate space 10*a* is separated into the refrigerant flow space and the oil flow space.

The first flow passage guide 410 here is manufactured in the shape of a ring, and is connected fixedly with an upper surface of the frame 31. The second flow passage guide 420 here is formed to be inserted into the stator 21 and to extend from an insulator that insulates a wound coil.

The first flow passage guide 410 is configured with a first annular wall portion 411 that extends upward at the outside, a second annular wall portion 412 that extends upward at the inside, and an annular surface portion 413 that extends in the radial direction in such a manner as to connect between the first annular wall portion 411 and the second annular wall portion 412. The first annular wall portion 411 is formed to be at a higher height than the second annular wall portion 412. A refrigerant through-hole is formed in the annular surface portion 413 in such a manner that a refrigerant hole provides communication from the compressor unit 30 to the intermediate space 10*a*.

Then, a first balance weight 261 is positioned inward from the second annular wall portion 412, that is, in the rotation shaft direction. The first balance weight 261 is connected to the rotator 22 or the rotation shaft 50 for rotation. At this point, the first balance weight 261 rotate to agitate refrigerant. The first balance weight 261 prevents the refrigerant from moving toward the first balance weight 261 due to the second annular wall portion 412, and thus suppresses the refrigerant from being agitated by the first balance weight 261.

The second flow passage guide 420 is configured with a first extension portion 421 that extends downward at the outside of the insulator, and a second extension portion 422 that extends downward at the inside of the insulator. The first extension portion 421 is formed in such a manner as to overlap the first annular wall portion 411 in the axial direction, and plays the role of performing separation into the refrigerant flow space and the oil flow space. The second extension portion 422 may not be formed if necessary. In a case where the second extension portion 422 is formed, it is desirable that the second extension portion 422 does not overlap the second annular wall portion 412 in the axial direction. In a case where the second extension portion 422 is formed to overlap the second annual wall portion 412, it is desirable that the second extension portion 422 is positioned in the radial direction at a sufficient distance away from the second annual wall portion 412 in such a manner that the refrigerant flows sufficiently.

A passage sealing member 430 for completely separating two spaces, that is, the first space 10*a* and a space at the outside of the first space 10*a*, is provided between the first annular wall portion 411 of the first flow passage guide 410 and the second extension unit 421 of the second flow passage guide 420.

On the other hand, an upper portion of the rotation shaft 50 is pressure-inserted into the center of the rotator 22 for combination and a lower portion thereof is connected to the compression unit 30 for support in the radial direction. Accordingly, the rotation shaft 50 transfers the rotary power of the electric motor 20 to the orbiting scroll 33 of the compression unit 30. Then, the second scroll 33 that is eccentrically connected to the rotation shaft 50 performs an orbiting motion with respect to the first scroll 32.

The main bearing unit (hereinafter referred to as the first bearing unit) 51, which is inserted into the first shaft bearing hole 312*a* in the frame 31 for support in the radial direction, is formed on a lower half portion of the rotation shaft 50. The sub-bearing unit 52 (hereinafter referred to as the second bearing unit) 52, which is inserted into the second shaft bearing hole 326*a* in the first scroll 32 for support in the radial direction, is formed under the first bearing unit 51. Then, the eccentricity portion 53, which is inserted into the rotation shaft combination portion 333 for combination, is formed between the first bearing unit 51 and the second bearing unit 52.

The first bearing unit 51 and the second bearing unit 52 is formed on the same axial line, in such a manner as to have the same axial center. The eccentricity portion 53 is essentially formed in the radial direction with respect to the first bearing unit 51 or the second bearing unit 52. The second bearing unit 52 may be eccentrically formed with respect to the first bearing unit 51.

In a case where an outside diameter of the eccentricity portion 53 is formed to be smaller than an outside diameter of the first bearing unit 51, but to be greater than an outside diameter of the second bearing unit 52, is advantageous in that the rotation shaft 50 passes the shaft bearing holes 312*a* and 326*a* and the rotation shaft combination portion 333 for combination. However, in a case where the eccentricity portion 53 is formed using a separate bearing, without being integrally with the rotation shaft 50, the rotation shaft 50 is inserted for combination even if the outside diameter of the second bearing unit 52 is formed to be smaller than the outside diameter of the eccentricity portion 53.

Then, an oil supply flow passage 50*a* for supplying oil to each bearing unit and the eccentricity portion is formed, along the axial direction, inside of the rotation shaft 50. The compression unit 30 is positioned more downward than the electric motor 20, and thus the oil supply flow passage 50*a* is formed, by grooving, to a height from a lower end of the rotation shaft 50 to approximately a lower end of the stator 21, to the middle of the height, or to a position that is higher than an upper end of the first bearing unit 51. Of course, when necessary, the oil supply path 50*a* may be formed to pass through the rotation shaft 50 in the axial direction.

Then, an oil feeder 60 for pumping the oil with which the lower space 10*c* is connected to the lower end of the rotation shaft 50, that is, a lower end of the second bearing unit 52. The oil feeder 60 is configured to include an oil supply pipe 61 that is inserted into the oil supply flow passage 50*a* in the rotation shaft 50 for combination, and a blocking member 62 that accommodate the oil supply pipe 61 and block introduction of a foreign material. The oil supply pipe 61 is positioned to pass through the discharge cover 34 and to be immersed in the oil in the lower space 10*c*.

On the other hand, as illustrated in FIG. 3, a sliding member oil supply path F1 for supplying oil to each sliding member, which is connected to the oil supply flow passage 50*a*, is formed in each bearing unit 51 or 52 of the rotation shaft 50 and the eccentricity portion 53.

The sliding member oil supply path F1 is configured to include a plurality of oil supply holes, that is, oil supply holes 511, 521, and 531 to pass through in the oil supply flow passage 50*a* toward an outer circumferential surface of the rotation shaft 50, and a plurality of oil supply grooves, that is, oil supply grooves 512, 522, and 532 in the bearing units 51 and 52 and an outer circumferential surface of the eccentricity portion 53, which communicate with the oil supply holes 511, 521, and 531, respectively, for lubricating the bearing units 51 and 52 and the eccentricity portion 53 with oil.

For example, the first oil supply hole 511 and the first oil supply groove 512 are formed in the first bearing unit 51, the second oil supply hole 521 and the second oil supply groove 522 are formed in the second bearing unit 52, and the third oil supply hole 531 and the third oil supply groove 532 are formed in the eccentricity portion 53. The first oil supply groove 512, the second oil supply groove 522, and the third oil supply groove 532 each are formed in the shape of a longitudinal groove that runs lengthwise in the axial direction or in an inclination direction.

Then, a first connection groove 541 and a second connection groove 542 are formed between the first bearing unit 51 and the eccentricity portion 53, and the eccentricity portion 53 and the second bearing unit 52, respectively. A lower end of the first oil supply groove 512 communicates with the first connection groove 541, and an upper end of the second oil supply groove 522 communicates with the second connection groove 542. Thus, a portion of the amount of oil with which the first bearing unit 51 is lubricated along the first oil supply groove 512 flows along the first connection groove 541, and collects. This oil is in turn introduced into the first backpressure chamber S1 and forms backpressure of discharge pressure. Furthermore, oil with which the second bearing unit 52 is lubricated along the second oil supply groove 522, and oil with which the eccentricity portion 53 is lubricated along the third oil supply groove 532 collects on the second connection groove 542. This oil in turn passes between a front surface of the rotation shaft combination portion 333 and the first disc portion 321 and is introduced into the compression unit 30.

Then, a small amount of oil that is absorbed upward above the first bearing unit 51 flows out from an upper end of the first shaft bearing unit 312 of the frame 31 to outside of the bearing surface, then flows over the first shaft bearing unit 312 down to an upper surface 31*a* of the frame 31, and lastly flows over the oil flow passages PO1 and PO2, which are successively formed on an outer circumferential surface (or a groove in an upper surface, which communicates with the outer circumferential surface) of the frame 21 and an outer circumferential surface of the first scroll 32, respectively, into the lower space 10*c* for collection.

In addition, oil that, along with the refrigerant, is discharged from the compression chamber V to the upper space 10*b* in the casing 10 is separated from the refrigerant in the upper space 10*b* in the casing 10, and then flows along the first oil flow passage PO1, which is formed in an outer circumferential surface of the electric motor 20, and the second oil flow passage PO2, which is formed in an outer circumferential surface of the compression unit 30, into the lower space 10*c* for collection. The flow passage separation unit 40, which will be described below, is provided between the electric motor 20 and the compression unit 30. Thus, the oil, which is separated from the refrigerant in the upper space 10*b* and flows into the lower space 10*c*, interferes with and is mixed again with the refrigerant that is discharged in the compression unit 20 and flows into the upper space 10*b*. The oil and the refrigerant flow along paths PO1 and PO2 and the paths PG1 and PG2, which are different from each other, into the lower space 10*c* and the upper space 10*b*, respectively.

On the other hand, a compression chamber oil-supply path F2 for supplying the oil that flows along the oil supply flow passage 50*a* and then is absorbed upward, to the compression chamber V is formed in the second scroll 33. The compression chamber oil-supply path F2 is connected to the sliding member oil supply path F1, which is described above.

The compression chamber oil-supply path F2 is configured to include a communicating first oil supply flow path 371 that connects between the oil supply flow passage 50*a* and the second backpressure chamber S2 that serves as the intermediate pressure space, and a second oil supply flow path 372 that communicates with the intermediate pressure chamber of the compression chamber V.

Of course, the directly-communicating compression chamber oil-supply path F2 may be formed to connect between the oil supply flow passage 50*a* and the intermediate pressure chamber without the second backpressure chamber S2 being involved. However, in this case, a communicating refrigerant flow passage needs to be separately provided between the second backpressure chamber S2 and the intermediate pressure chamber V, and an oil flow passage for supplying oil to the oldham ring 35 that is positioned in the second backpressure chamber S2 needs to be separately provided. This increases the number of paths and makes processing complex. Therefore, at least to unify the refrigerant flow passage and the oil flow passage and thus to decrease the number of paths, as in the present embodiment, it is desirable that the oil supply flow passage 50*a* and the second backpressure chamber S2 communicates with each other and that the second backpressure chamber S2 communicates with the intermediate pressure chamber V.

To do this, the first oil supply path 371 includes a first orbiting path portion 371*a* that is formed in the lower surface of the second disc portion 331 to run up to the middle in the thickness direction, a second orbiting path portion 371*b* that is formed to extend from the first orbiting path portion 371*a* toward an outer circumferential surface of the second disc portion 331, and third orbiting path portion 371*c* to pass through toward the upper surface of the second disc portion 331, which is formed to extend from the second orbiting path portion 371*b*.

Then, the first orbiting path portion 371*a* is formed in a position in which the first backpressure chamber S1 is positioned, and the third orbiting path portion 371*c* is formed in a position in which the second backpressure chamber S2 is positioned. Then, a pressure reducing bar 375 is inserted into the second orbiting path portion 371*b* in such a manner that pressure of oil that flows from the first backpressure chamber S1 to the second backpressure chamber S2 along the first oil supply path 371 is reduced. Accordingly, a cross-sectional area of the second orbiting path portion 371*b* except for the pressure reducing bar 375 is smaller than that of the first orbiting path portion 371*a* or the third orbiting path portion 371*c*.

At this point, in a case where an end portion of the third orbiting path portion 371*c* is formed in such a manner that the end portion is positioned inward than the oldham ring 35, that is, is positioned between the oldham ring 35 and the sealing member 36, oil that flows along the first oil supply path 371 is blocked by the oldham ring 35 and thus does not flow smoothly to the second backpressure chamber S2. Therefore, in this case, a fourth orbiting path portion 371*d* is formed to extend from an end portion of the third orbiting path portion 371*c* toward the outer circumferential surface of the second disc portion 331. The fourth orbiting path portion 371*d*, as illustrated in FIG. 4, may be formed to be a groove in an upper surface of the second disc portion 331, and may be formed to be a hole in the inside of the second disc portion 331.

The second oil supply path 372 includes a first stationary path portion 372*a* that is formed in an upper surface of the second side-wall portion 322 in the thickness direction, a second stationary path portion 372*b* that is formed to extend from the first stationary path portion 372*a* in the radial direction, and third stationary path portion 372*c* that is formed to extend from the second stationary path portion 372*b* and to communicate with the intermediate pressure chamber V.

A reference numeral 70 in the drawing, which is not described, indicates an accumulator.

The lower compression type of scroll compressor according to the present embodiment, which is described above, operates as follows.

That is, when the electric motor 20 is powered on, rotary power occurs to the rotator 22 and the rotation shaft 50, and the rotator 22 and the rotation shaft 50 rotate. As the rotation shaft 50 rotates, with the Oldham ring 35, the orbiting scroll 33 that is eccentrically connected to the rotation shaft 50 performs the orbiting motion.

Then, a refrigerant that is supplied from outside of the casing 10 through the refrigerant absorption pipe 15 is introduced into the compression chamber V. This refrigerant is compressed as the volume of the compression chamber V decreases by the orbiting motion of the orbiting scroll 33. The compressed refrigerant is discharged into the internal space in the discharge cover 34 through the discharge outlets 325*a* and 325*b*.

Then, the refrigerant that is discharged into the internal space in the discharge cover 34 circulates in the internal space in the discharge cover 34. After noise decreases, the refrigerant flows into a space between the frame 31 and the stator 21, and flows into an upper space over the electric motor 20 through a space between the stator 21 and the rotator 22.

Then, the refrigerant that results from separating the oil from the refrigerant in the upper space over the electric motor 20 is discharged to outside of the casing 10 through the refrigerant discharge pipe 16, and on the other hand, the oil flows into the lower space 10*c* that is the oil storage space in the casing 10 through a passage between the inner circumferential surface of the casing 10 and the stator 21 and a passage between the inner circumferential surface of the casing 10 and the outer circumferential surface of the compression unit 30. A sequence of these processes is repeated.

At this time, the oil in the lower space 10*c* is absorbed upward flowing along the oil supply flow passage 50*a* in the rotation shaft 50, and the first bearing unit 51 and the second bearing unit 52, and the eccentricity portion 53 are lubricated with the oil that flows along the oil supply holes 511, 521, and 531 and the oil supply grooves 512, 522, and 532, respectively.

The oil that flows along the first oil supply hole 511 and the first oil supply groove 512, with which the first bearing unit 51 is lubricated, collects in the first connection groove 541 between the first bearing unit 51 and the eccentricity portion 53 and is introduced into the first backpressure chamber S1. The oil generates almost discharge pressure and thus pressure in the first backpressure chamber S1 is increased to the discharge pressure. Therefore, the center portion side of the second scroll 33 is supported, in the axial direction, by the discharge pressure.

On the other hand, the oil in the first backpressure chamber S1 flows into the second backpressure chamber S2 along the first oil supply path 371 due to a pressure difference with the second backpressure chamber S2. At this time, the pressure reducing bar 375 is provided in the second orbiting path portion 371*b* that serves as the first oil supply path 371, and thus pressure of the oil that flows toward the second backpressure chamber S2 is reduced.

Then, the oil that flows into the second backpressure chamber (the intermediate pressure space) S2 supports an edge portion of the second scroll 33, and at the same time, flows into the intermediate pressure chamber V along the second oil supply path 372 due to a pressure difference with the intermediate pressure chamber V. However, when pressure in the intermediate pressure chamber V is higher than pressure in the second backpressure chamber S2 during the operation of the compressor, the refrigerant flows from the intermediate pressure chamber V toward the second backpressure chamber S2 along the second oil supply path 372. In other words, the second oil supply path 372 plays the role of a passage along which the refrigerant and the oil flow in opposite directions due to the pressure difference between the second backpressure chamber S2 and the intermediate pressure chamber V.

As described above, the oil separation unit 40 is installed in the intermediate space (hereinafter referred to as a first space) 10*a* that is a passing-through space which is formed between a lower surface of the electric motor 20 and an upper surface of the compression unit 30. The oil separation unit 40 plays the role of preventing the refrigerant that is discharged from the compression unit 30 from interfering with the oil that flows from the upper space (hereinafter referred to as a second space) 10*b* in the electric motor 20, which is the oil separation space, into a lower space (hereinafter referred to as a third space) 10*c* in the compression unit 30 that is the oil storage space. Accordingly, the refrigerant and the oil are discharged together in the compressor unit 30, pass through the electric motor 20. The refrigerant and the oil that pass through the electric motor 20 are separated into the refrigerant and the oil in the second space 10*b* that is the upper space. The separated oil flows over a first oil flow passage PO1 and a second oil flow passage PO2 into the third space 10*c*, which is the oil storage space, for collection.

However, because an oil separation device is not present in the second space 10*b*, or because an oil separation effect is small although the oil separation device is present there, there is a concern that the oil will be driven out of the compressor along with the refrigerant. If so, an amount of oil that flows into the third space 10*c* that is the oil storage space in the compressor, for collection, greatly decrease, and thus an amount of oil that is supplied to the sliding member decrease. As a result, friction loss or abrasion occurs.

Particularly, the separation of oil within the compressor has a strong relationship with a flow speed of the refrigerant (hereinafter referred to as refrigerant oil) include the oil. It is known that, in a case where the flow speed of the refrigerant oil is low or high, normally, a centrifugal separation technique is suitable. In the case of the low speed, inter-particle collision does not actively take place, but the degree to which the refrigerant oil spread is low. This increases a particle size of the oil. Thus, the oil separation effect that results from gravitational precipitation is improved. In the case of the high speed, the inter-particle collision actively takes place, and oil particles are combined. The combined oil particles is more pulled by the centrifugal force than the refrigerant. Thus, due to the oil separation effect that results from inertia, the oil is separated from the refrigerant.

However, in the case of an intermediate speed, it is difficult to expect the oil separation effect in the case of the low speed, which results from the gravitational precipitation, or the oil separation effect in the case of the high speed, which results from the inertia. Therefore, in the case of the intermediate speed, it is desirable that the oil separation device is provided rather than employing the centrifugal separation technique.

However, in the related art, as described above, the oil is separated without the oil separation device being provided, using the gravitational precipitation technique or the centrifugal separation technique in the space, and thus, the gravitational precipitation technique or the centrifugal separation technique is expected to have its own effect in the low-speed or high-speed operation (the term speed of flow within a compression casing is actually an exact expression, but for convenience, the term operation speed of a compressor is hereinafter instead used because the speed of flow is approximately proportional to the operation speed of the compressor). However, the gravitational precipitation technique or the centrifugal separation technique has a limitation in that the oil separation is small. However, in a case where the second space 10*b* is too much enlarged in order to secure an oil separation space, the compressor increases in size. Thus, a volume of the second space 10*b* has to be limited. Therefore, the oil is not sufficiently separated from the refrigerant oil that is introduced in the second space 10*b*, and thus is driven out of the compressor along with the refrigerant. As a result, an oil shortage occurs within the compressor. In particular, during a high-speed operation, a circulation amount of the refrigerant and the oil increases, and the amount of the oil discharged from the compressor to the refrigeration cycle may also increase. However, since a simple centrifugal separation technique is unable to sufficiently separate the oil from the refrigerant oil, a flow rate of the oil may increase, thereby increasing the friction loss or wear of the sliding member inside the compressor. This situation will be described below with reference to FIG. 10.

Figure 5:
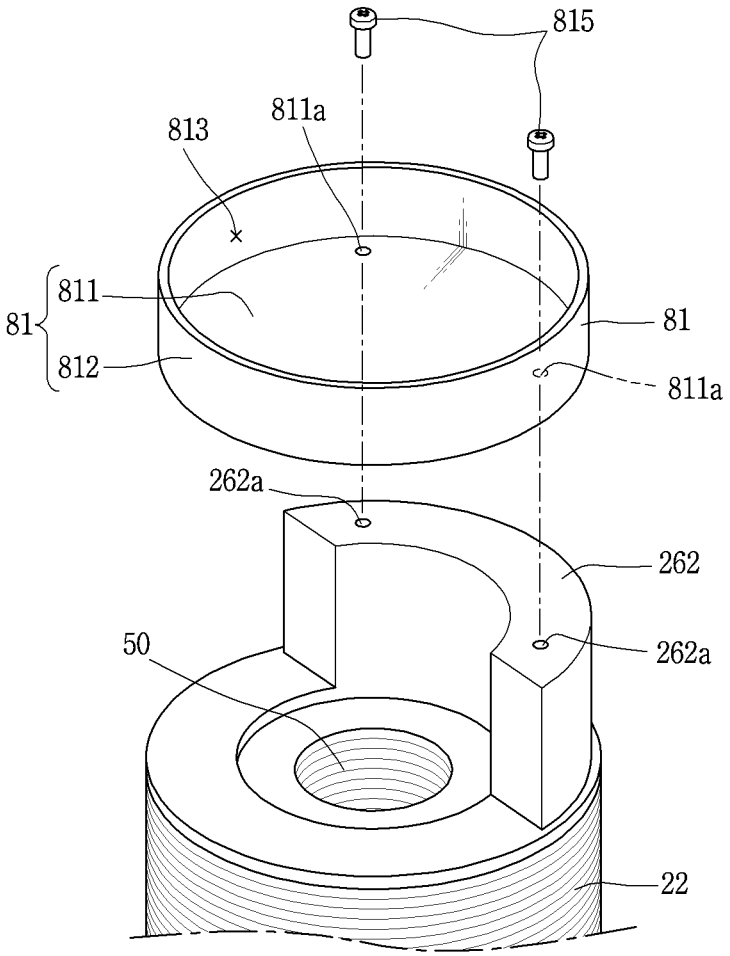
FIG. 5 is an exploded diagram illustrating an oil passage separation unit in the scroll compressor in FIG. 1.
Figure 6:
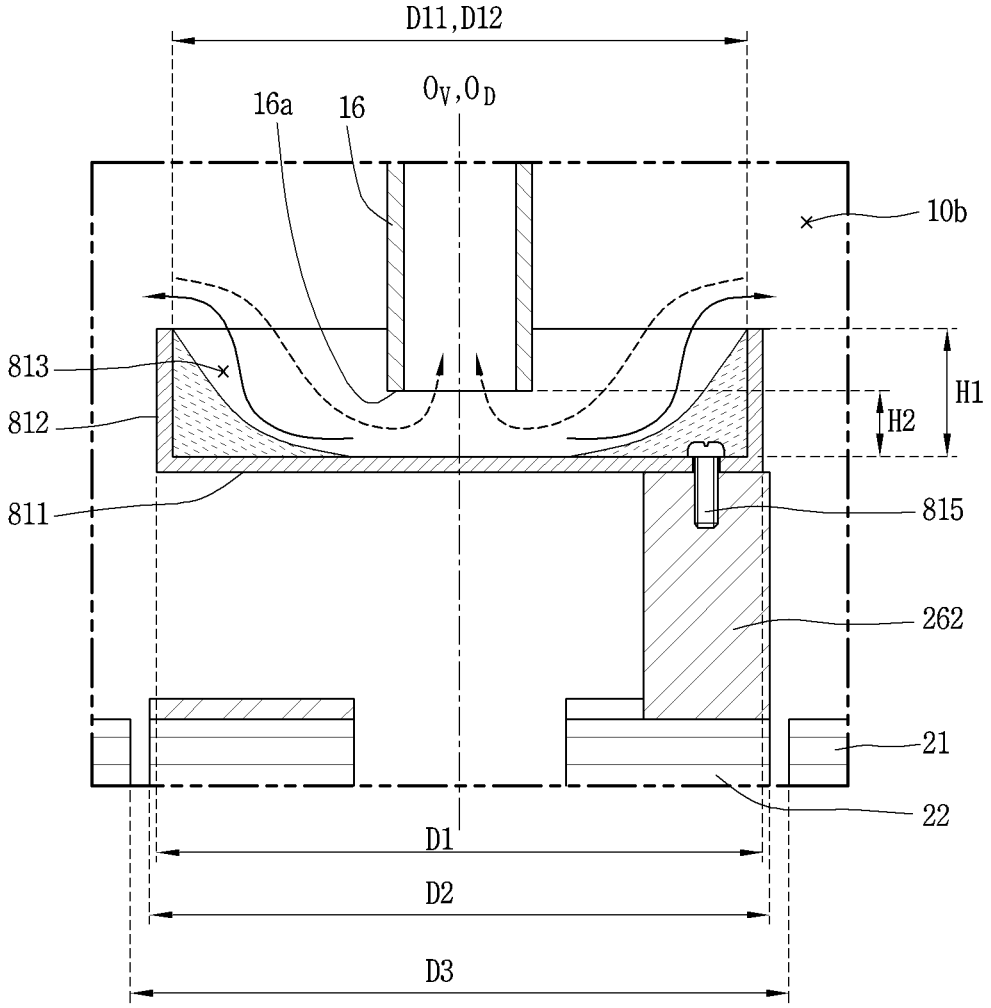
FIG. 6 is a vertical cross-sectional diagram illustrating an assembled state of the oil separation unit in FIG. 5.

With the problem in mind, the lower compressor type of scroll compressor according to the present embodiment includes an oil separation unit that actively deals with a change in the operation speed of the compressor, in the second space. FIGS. 5 and 6 are diagrams, each illustrating an example of the oil separation unit.

As illustrated, an oil separation unit 80 according to the present embodiment is configured with an oil separation member 81 that is connected to the upper side of the rotator 22. At this point, the oil separation member 81 is fixed an upper surface of a second balance weight 262 that will be described below and the second balance weight 262 is fastened to the rotator 22. Therefore, the oil separation member 81 is broadly defined as one portion of the rotator 22.

The oil separation member 81 is provided between the electric motor 20 and the refrigerant discharge pipe 16, and is formed into the shape of a truncated cup that has a space 813 which has a predetermined depth from the center portion. Accordingly, the oil separation member 81 separates the refrigerant and the oil, which are introduced into the space 813, from each other by the centrifugal force, while rotating along with the rotator 22. Thus, the oil separation effect is increased.

At this point, the oil separation member 81 is configured with a bottom portion 811 that extends toward the inner circumferential surface of the casing 10, and a side-wall portion 812 and protrudes upward from an edge of the bottom portion 811 to form the space 813 described above.

As illustrated, the bottom portion 811 is fixed to an upper surface of the second balance weight 262 that is provided on an upper surface of the rotator 22. In this case, a fastening hole 811*a* is formed in the bottom portion 811 in such a manner that, with a fastening member 815, such as a bolt or a rivet, the bottom portion 811 is fastened to a fastening groove 262*a* that is provided in the second balance weight 262.

As illustrated, the bottom portion 811 is formed in such a manner an outside diameter D1 of the bottom portion 811 is equal to or smaller than an outside diameter D2 of the rotator 22 (or the second balance weight 262). Of course, the greater an outside diameter of the oil separation member 81 that includes the bottom portion 811, the greater the centrifugal force that is exerted on the refrigerant oil. However, when considering the fact that the oil separation member 811 is inserted into the stator 21 in a state of being connected to the rotator 22, it is desirable that a maximum outside diameter D2 of the oil separation member 81 is equal to or smaller than an inside diameter D3 of the stator 21. It is more preferable that the maximum outside diameter D2 is equal to or smaller than the outside diameter D2 of the rotator 22.

The side-wall portion 812 is formed into the shape of a ring. The side-wall portion 812 is formed in such a manner that inside diameters D11 and D12 are greater than an outside diameter of the refrigerant discharge 16. Thus, although the refrigerant discharge pipe 16 is inserted to a predetermined depth into the space 813, a space through the oil flows is formed between an inner circumferential surface of the side-wall portion 812 and an outer circumferential surface of the refrigerant discharge pipe 16.

Then, it is desirable that the side-wall portion 812 is formed in such a manner that a height H1 of the side-wall portion 812 is greater than a distance H2 from an upper surface of the bottom portion 811 to an end portion 16*a* of the refrigerant discharge pipe 16. Accordingly, the end portion 16*a* of the refrigerant discharge pipe 16 is inserted and thus the end portion 16*a* of the refrigerant discharge pipe 16 overlaps the side-wall portion 812 in the axial direction. This is desirable because a situation is minimized where the oil that is separated in the second space 10*b* flows back into the space 813 and is driven out of the compressor through the refrigerant discharge pipe 16.

Then, the side-wall portion 812 according to the present embodiment may be formed to protrude in a direction perpendicular to the bottom portion 881. Accordingly, as illustrated in FIG. 6, the side-wall portion 812 is formed in such a manner as to have the same inner diameters D11 and D12 from the lower end to the upper end thereof.

However, in this case, the oil that is separated from the refrigerant oil and flows into the space 813 is blocked by the side-wall portion 812, and this prevents the oil from smoothly flowing in a dispersed manner out of the space 813. Particularly, in the case of the low-speed operation, because a weak centrifugal force arises, a large amount of oil stays in the space 813 and this prevents the refrigerant oil from being introduced into the refrigerant discharge pipe 16.

Figure 7:
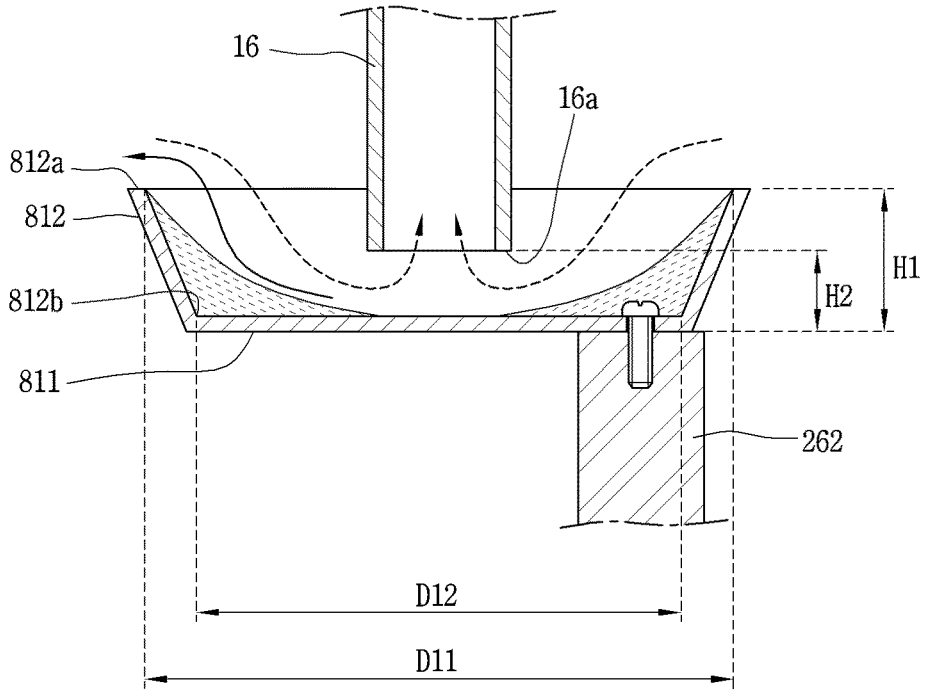
FIG. 7 is a vertical cross-sectional diagram illustrating an oil separation member according to another embodiment, in the oil separation unit that is illustrated in FIG. 5.
Figure 8:
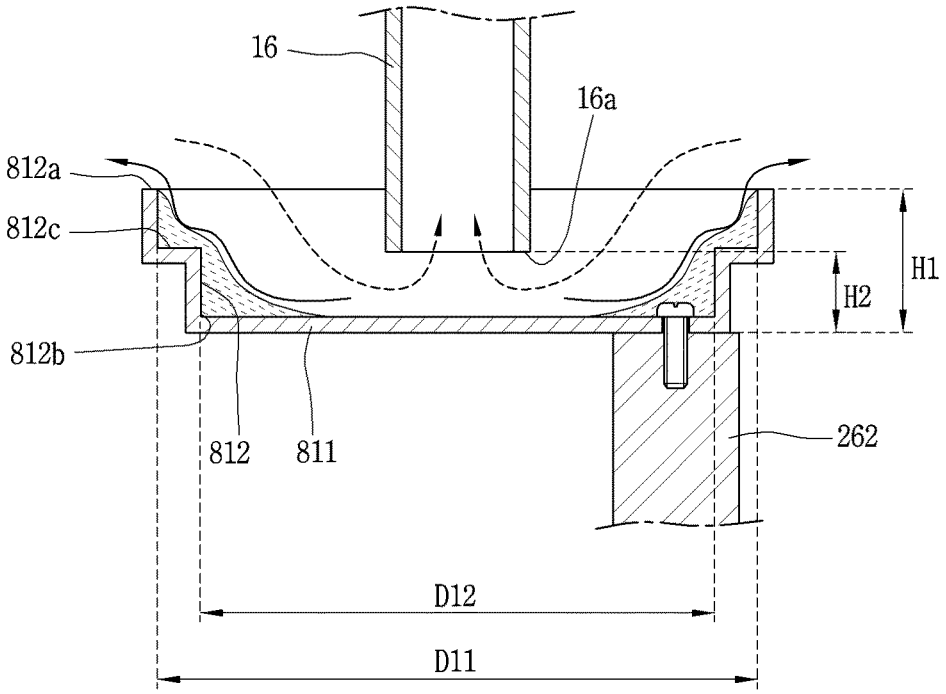
FIG. 8 is a vertical cross-sectional diagram illustrating an oil separation member according to another embodiment, in the oil separation unit that is illustrated in FIG. 5.

With this in mind, the side-wall portion 812 is formed in such a manner that the inside diameter D11 of an upper end 812*a* is more enlarged than the inside diameter D12 of a lower end 812*b*. For example, as illustrated in FIG. 7, the side-wall portion 812 may be slantly formed. Alternatively, as illustrated in FIG. 8, a stepped surface 812*c*, which has at least two or more steps at the middle of a height of the side-wall portion 812, is formed. Accordingly, the oil in the space 813 smoothly flows in a dispersed manner out of the space 813, and thus flow resistance to the discharge of the refrigerant is prevented in advance from occurring.

Then, it is desirable that the side-wall portion 812 is formed in such a manner that the center of the side-wall portion 812, that is, the center OV of the space 813, and the center OD of the refrigerant discharge pipe 16 are positioned on the same axis. Accordingly, the refrigerant that is introduced along a circumferential direction of the space 813 is equally guided to the refrigerant discharge pipe 16.

Figure 9:
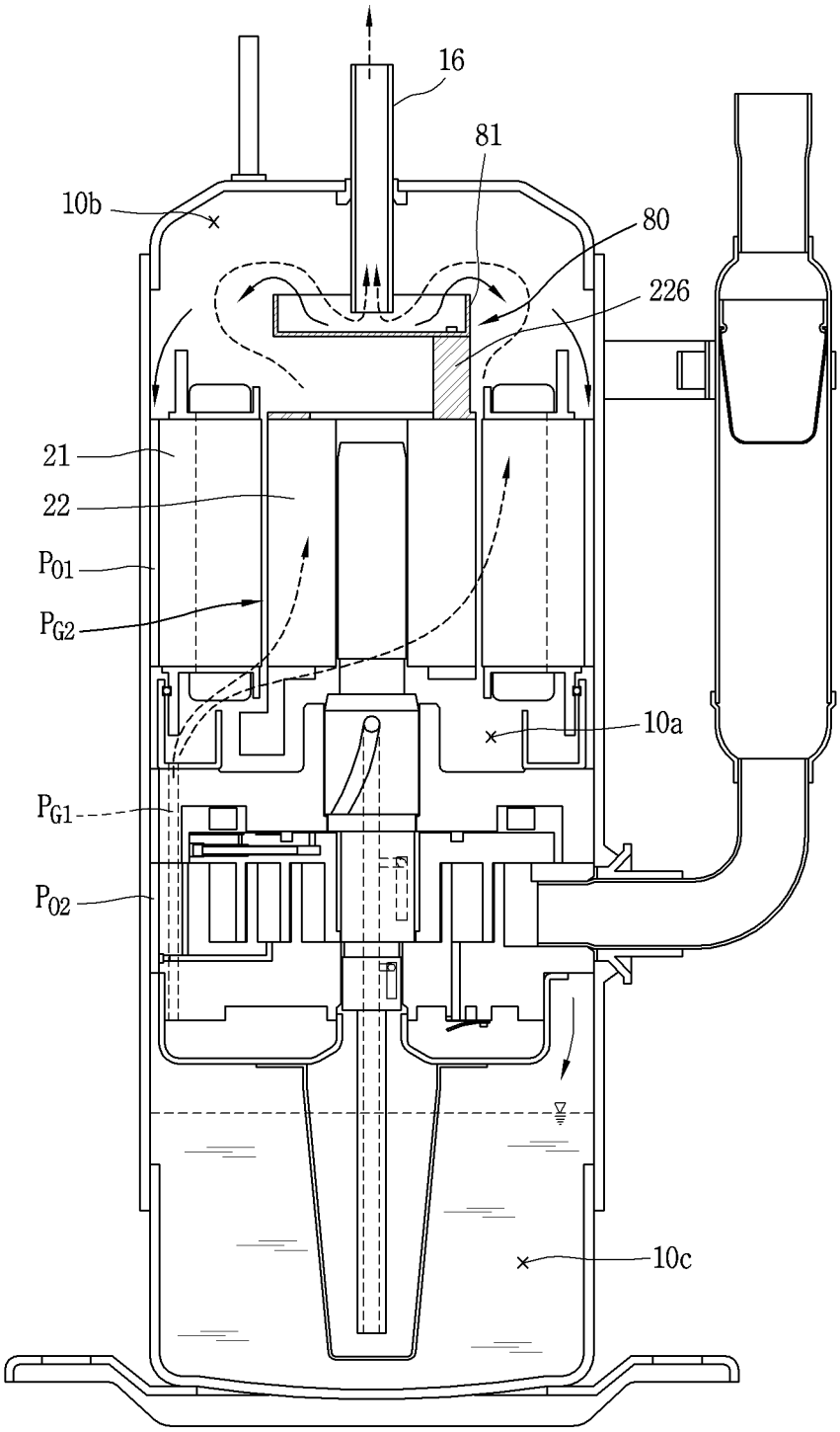
FIG. 9 is a schematic diagram for describing a process in which refrigerant and oil circulate in the lower compressor type of scroll compressor that is illustrated in FIG. 1.

A process of separating oil form refrigerant in the scroll compressor according to the present embodiment, as described above, is as follows. FIG. 9 is a schematic diagram for describing a process in which the refrigerant and the oil circulate in the lower compressor type of scroll compressor that is illustrated in FIG. 1.

As illustrated, refrigerant oil that is discharged from the compressor unit 30 is introduced into the second space 10*b* through the first refrigerant flow passage PG1 and the second refrigerant flow passage PG2, in a state where oil is included in the refrigerant oil.

Then, the refrigerant (indicated by a dotted-line arrow) and the oil (indicated by a solid line arrow) that are introduced into the second space 10*b* flow by the bottom portion 811 of the oil separation member 81 in a dispersed manner in a direction of the inner circumferential surface of the casing 10, and flow over the side-wall portion 812 of the oil separation member 81 toward the refrigerant discharge pipe 16 into the space 813. Thus, the space 813 is filled with the refrigerant and the oil.

At this time, as the oil separation member 81 continues to rotate, the refrigerant and the oil with which the space 813 is filled are pulled by the centrifugal force, and thus the refrigerant and the oil are separated from each other in the space 813. That is, the bottom portion 811 of the oil separation member 81, along with the side-wall portion 812, forms the space 813 that is closed in the radial direction, and thus oil particles collide with and are combined with many more other oil particles into bigger oil particles. As a result, the bigger oil particles have more inertia and is caused to converge in the vicinity of an internal flank surface of the side-wall portion 812. The oil that is caused to converge in the vicinity of the inner flank surface of the side-wall portion 812 flows over the side-wall portion 812 and flows dispersedly into the second space 10*b*.

Then, an empty space is formed in the vicinity of the center of the space 813, and is filled with the refrigerant that is less pulled by the centrifugal force than the oil. The refrigerant is driven by pressure out of the compressor throughout the refrigerant discharge pipe 16.

On the other hand, the oil that flows dispersedly into the second space 10*b* is hit by the centrifugal force against the inner circumferential surface of the casing 10 and flows down along the inner circumferential surface of the case 10 or flows dispersedly. Thus, the oil is guided toward the first oil flow passage PO1.

Then, by gravity, the oil collects into the third space 10*c* through the first oil flow passage PO1 and the second oil flow passage PO2, and the oil that collects is resupplied by the oil feeder 60 to the sliding member.

At this point, some of the oil that flows dispersedly into the second space 10*b* is swept by the refrigerant and thus may be introduced back into the space 813. However, because the space 813 is limited by the side-wall portion 812, it is very difficult for the oil to flow over the side-wall portion 812 and to be introduced into the space 813. Thus, the oil is more effectively suppressed from being driven out of the compressor through the refrigerant discharge pipe 16.

Accordingly, the oil separation unit according to the present embodiment smoothly separates the oil from the refrigerant while the compressor operates in the high speed, or the low or intermediate speed. The oil separation effect associated with this is illustrated in FIG. 10.

Figure 10:
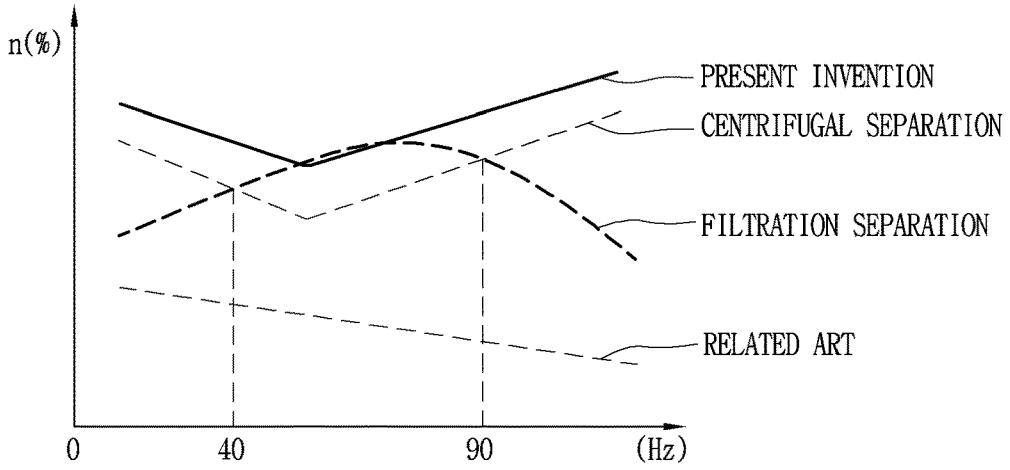
FIG. 10 is a graph for describing an effect of the oil separation unit according to the present invention.

From FIG. 10, it is shown that, in a case where the oil separation unit is not included (in the compressor in the related art), as the operation speed of the compressor increases, an oil separation rate (n %) rapidly decreases. This means that, as the operation speed increases, the amount of leaking oil rapidly increases.

However, it is shown that, in a case where as in the present embodiment, the oil separation unit 80 that includes the space is provided, the oil separation rate (n %) is improved than in the compressor in the related art, which does not include the oil separation unit, and is also improved than when employing the centrifugal separation technique that does not use the space. It is apparent that, as described above, as a result of the present embodiment employing the centrifugal separation technique that uses the space 813, the oil has more inertia, and thus that the oil separation rate (%) in a high-speed (approximately 90 Hz or higher) or low-speed (approximately 40 to 50 Hz or lower) range is greatly improved.

On the other hand, it is shown that, in a case where, as in the present embodiment, the oil separation unit 80 that includes the space 813 is provided, the oil separation rate (n %) is improved in the high-speed and low-speed range, which are described above, and even in the intermediate-speed (approximately 50 to 90 Hz) range, as is the case with a filtration and separation technique. It is apparent that, as described above, as a result of employing the centrifugal separation technique that uses the space, the oil has more inertia, and thus that the oil separation rate (%) in the intermediate-speed (approximately 50 to 90 Hz) range is greatly improved.

Thus, according to the present embodiment, regardless of the operation speed of the compressor, the refrigerant and the oil can be effectively separated from each other, and thus the oil shortage within the compressor can be prevented in advance.

On the other hand, an oil separation unit according to another embodiment of the present invention is as follows.

That is, in the embodiment described above, the oil separation unit is configured only with the oil separation member in the shape of a truncated cup, but in the present embodiment, a mesh or an oil separation plate is further included on an end portion of the refrigerant discharge pipe.

Figure 11:
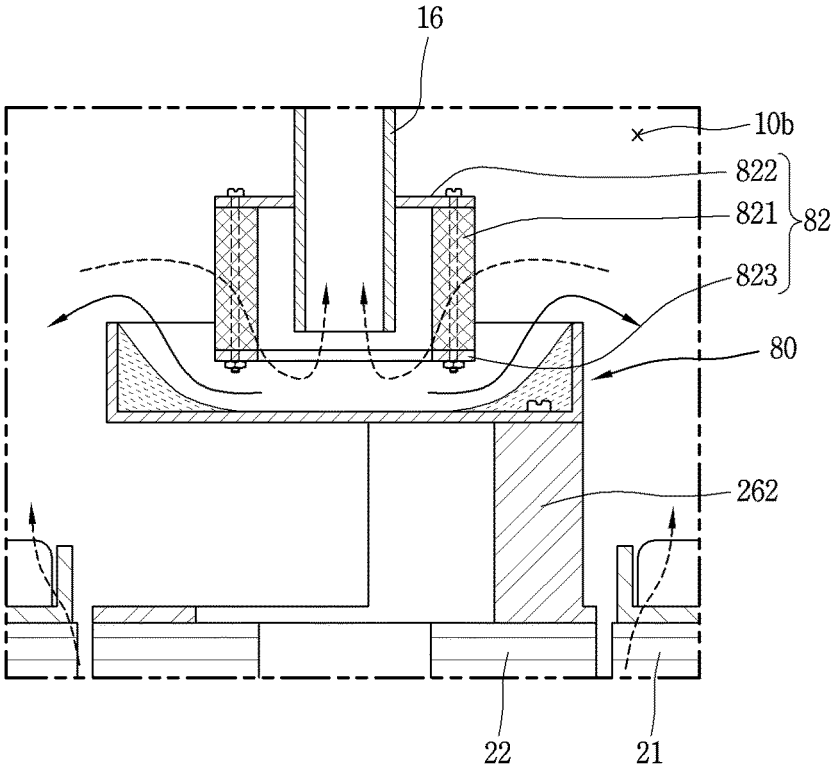
FIG. 11 is a vertical cross-sectional diagram illustrating an oil separation unit according to another embodiment of the present invention.

For example, as illustrated in FIG. 11, a mesh 82 in the shape of a ring is combined in the vicinity of an inlet end of the refrigerant discharge pipe 16. An upper surface of the mesh member 821 in the shape of a cylinder is supported by a plate 822 that is closed, and a lower surface of the mesh member 821 is supported by a plate 823 in the shape of a ring, which is open.

Then, the mesh member 821 may be formed in such a manner that the mesh 821 is all positioned within the space 813, and in this case, a height of the mesh member 821 has to be too small or a height of the space 813 has to be too great. Therefore, if at least one portion of the mesh member 821 overlaps an end portion of the refrigerant discharge pipe 16 in the axial direction or has a height that overlaps a height of the space 813 in the axial direction, this is sufficient. Furthermore, in this case, although the end portion of the refrigerant discharge pipe 16 is not inserted into the space 813, the oil separation effect can be expected.

Furthermore, the mesh does not necessarily need to be formed into the shape of a mesh. For example, if the mesh employs any structure that shows the shape of a cylinder which has many fine holes in such a manner that oil is separated from refrigerant, this is sufficient.

Thus, the oil is filtered out in advance with a filtration technique while the refrigerant oil that is introduced from the second space 10*b* into the space 813 passes the mesh 82. That is, the oil that has not yet been filtered out with the centrifugal separation technique is separated. Thus, the oil separation rate (n %) is further improved.

Figure 12:
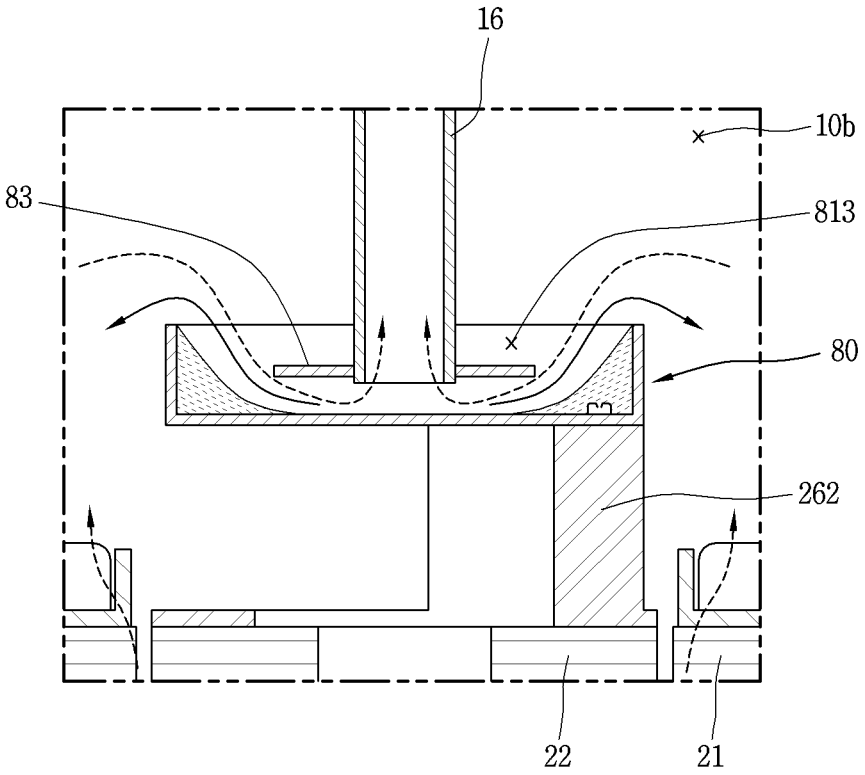
FIG. 12 is a vertical cross-sectional diagram illustrating the oil separation unit according to another embodiment of the present invention.

Furthermore, as illustrated in FIG. 12, at least one or more oil separation plates 83 are formed into the shape of a flange in the vicinity of the inlet end of the refrigerant discharge pipe 16. When the oil separation plate 83 is provided in such a manner as to be positioned within the space 813, the oil separation effect is increased.

Thus, the oil is filtered out in advance with a filtration technique while the refrigerant oil that is introduced from the second space 10*b* into the space 813 passes the oil separation plate 83. That is, the oil that has not yet been filtered out with the centrifugal separation technique is separated. Thus, the oil separation rate (n %) is further improved.

On the other hand, an oil separation unit according to another embodiment of the present invention is as follows.

That is, in the embodiments described above, the second balance weight is formed into the shape of an arc, and a portion of the oil separation member, which is fastened to the second balance weight, is eccentrically positioned. However, in the present embodiment, the second balance weight is formed into the shape of a ring, and a portion of the oil separation member, which is fastened to the second balance weight, is uniformly positioned.

Figure 13A:
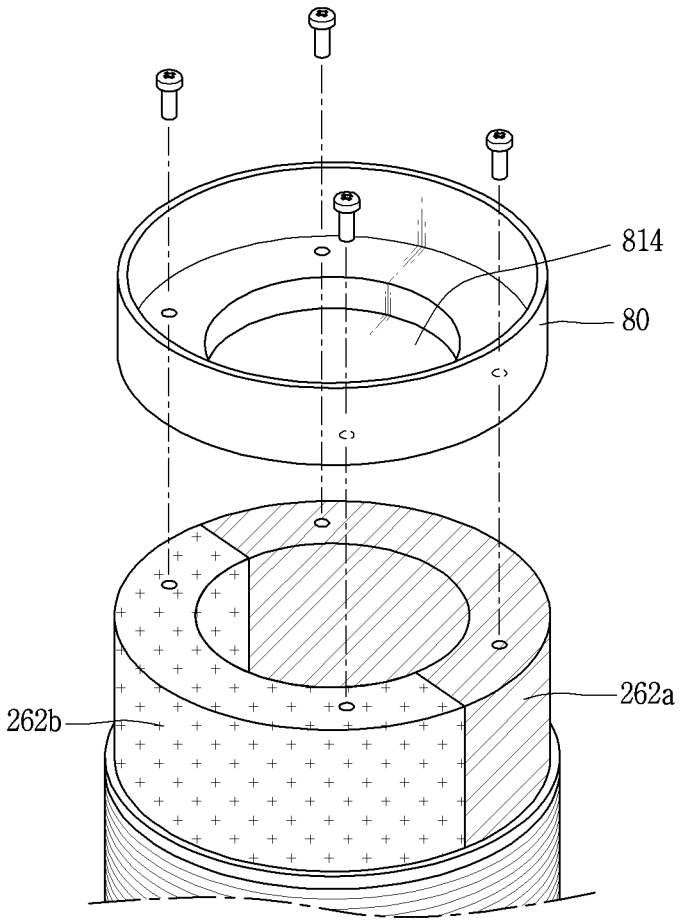
FIG. 13A is an explosive perspective diagram illustrating an oil separation unit according to another embodiment of the present invention.
Figure 13B:
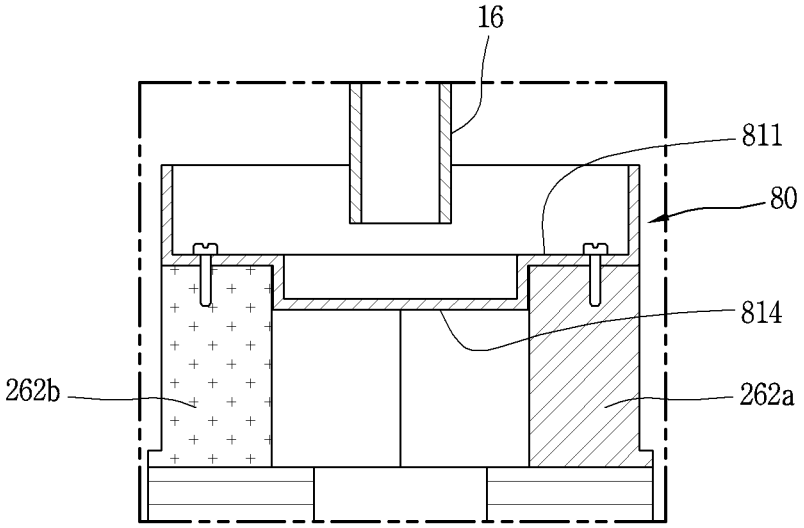
FIG. 13B is a cross-sectional diagram illustrating the assembled oil separation unit according to the embodiment of the present invention.

For example, as illustrated in FIGS. 13A and 13B, the second balance weight 262 as a whole is formed into the shape of a ring, but may be formed as a result of combining two different members in the shape of a semicircle. That is, a first mass portion 262*a* of the second balance weight 262 is formed of a relatively heavy material, and a second mass portion 262*b* of the second balance weight 262 is formed of a relatively light material or is formed into the shape of a cylinder that has an empty space in the center.

However, fastening grooves are formed in both of the mass portions 262*a* and 262*b*, respectively, of the second balance weight 262, and the bottom portion of the oil separation member 81 is fastened to the fastening grooves. That is, in the case, portions of the second weight 262, to which the oil separation member 81 are fastened, are positioned at the same or similar distances from each other along the circumferential direction.

Thus, a force to cause fastening to the oil separation member 81 is increased. As a result, although the space 813 in the oil separation member 81 is filled with oil and thus the centrifugal force is produced, the oil separation member 81 is stably supported. Because of this, although the compressor operates at the high speed for a long time, the oil separation member 81 is suppressed from being separated, and vibration and noise is suppressed from occurring all over the rotator as well as the oil separator member 81.

Furthermore, in this case, a fixing portion 814, which protrudes downward along the axial direction and is inserted into the inside of the second balance weight 262, is further formed on a lower surface of the bottom portion of the bottom portion 811 of the oil separation member 81. The fixing portion 814 is brought into close contact with an inner circumferential surface of the second balance weight 262. Thus, a process of assembling the oil separation member 81 is easy to perform, and additionally, the oil separation member 81 is supported by the fixing portion 814 in the radial direction on the second balance weight 262. Thus, a force to support the oil separation member is further increased, and thus vibration and noise are suppressed from occurring all over the compressor.

In a case where the second balance weight 262 is not only in the shape of a ring, but also in the shape of an arc, the fixing portion 814 as described above is formed in the same manner. In this case, at least one portion of the fixing portion 814 is supported in the radial direction on the second balance weight 262.

Figure 14:
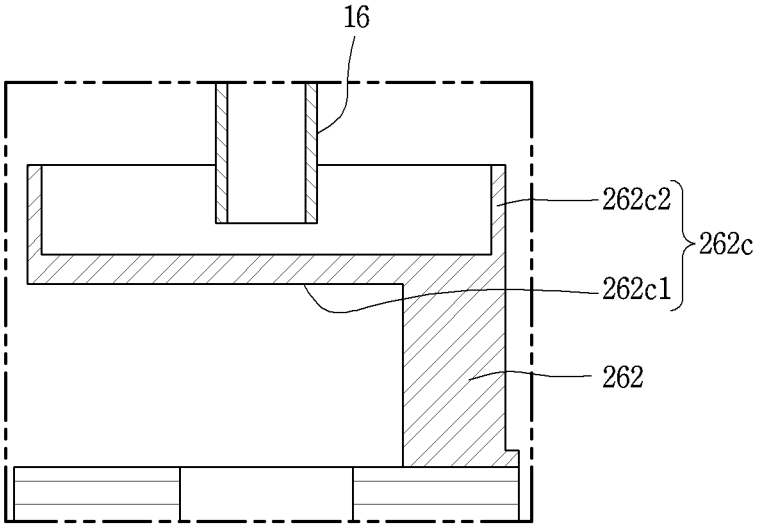
FIG. 14 is a cross-sectional diagram of an oil separation unit according to anther embodiment of the present invention.

On the other hand, in the embodiments described above, the oil separation member is fastened to the balance weight for fixation, but depending on the case, the oil separation member is integrally formed with the balance weight into a single body. For example, as illustrated in FIG. 14, an oil separation portion 262*c* is integrally formed with an upper end of the second balance weight 262 into a single body. The oil separation portion 262*c*, as described above, is formed in such a manner as to have a bottom portion 262*c*1 and a side-wall portion 262*c*2 that extends from the bottom portion 262*c*1. A basic configuration of the oil separation portion 262*c* is the same as in the embodiments described above.

However, in a case where the oil separation portion is integrally formed with the second balance weight into a single, although the oil separation portion is pulled by the centrifugal force that results from the oil, a concern that the oil separation will be separated can be completely eliminated, the second balance weight does not need to be formed into the shape of a ring, and the number of assembling components is reduced to save the man-hour assembling costs.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor comprising:

a casing that defines an internal space;

a drive motor comprising:

a stator located in the internal space of the casing, and a rotator located radially inward of the stator and configured to rotate with respect to the stator, the rotator defining an internal flow passage and an external flow passage that passes through the drive motor in an axial direction of the drive motor;

a rotation shaft connected to the rotator and configured to rotate based on rotation of the rotator;

a compression unit comprising:

a first scroll located vertically below the drive motor, and a second scroll that is located inside of the first scroll, that is connected to the rotation shaft, and that is configured to define a compression chamber based on rotation relative to the first scroll, the compression unit being configured to compress refrigerant in the compression chamber and to discharge compressed refrigerant toward the internal space of the casing;

a discharge pipe that communicates with an upper portion of the internal space of the casing and that is located vertically above the drive motor;

a balance weight connected to the rotator; and an oil separation member that is located between the drive motor and the discharge pipe, that defines a receiving space recessed from an upper surface of the oil separation member, and that is configured to, based on centrifugal force, separate oil from refrigerant discharged from the compression unit, wherein an inner diameter of the receiving space is greater than an outer diameter of the discharge pipe, and an end portion of the discharge pipe extends into the receiving space, wherein the oil separation member comprises:

a bottom portion that is located at an end portion of the rotator or that is connected to a connection part that connects to the rotator, the bottom portion being spaced apart from the discharge pipe, and a side-wall portion that protrudes upward from an edge of the bottom portion and that extends vertically above the end portion of the discharge pipe, wherein the bottom portion and the side-wall portion define the receiving space of the oil separation member, and wherein the oil separation member is coupled to an upper surface of the balance weight, or the oil separation member and the balance weight are portions of a single body.

2. The scroll compressor of claim 1, wherein the oil separation member further comprises a stationary portion that extends downward from the bottom portion of the oil separation member and that inserts into the balance weight, and wherein the balance weight is configured to support the stationary portion in a radial direction of the oil separation member.

3. The scroll compressor of claim 1, wherein a height of the side-wall portion in the axial direction is greater than or equal to a distance between an upper surface of the bottom portion and a lower end of the discharge pipe.

4. The scroll compressor of claim 1, wherein the side-wall portion slopes with respect to the bottom portion, and wherein an inner diameter of an upper end of the side-wall portion is greater than an inner diameter of a lower end of the side-wall portion.

5. The scroll compressor of claim 1, wherein the side-wall portion includes a stepped portion located at a lower side of the oil separation member, and wherein an inner diameter of an upper end of the side-wall portion is greater than an inner diameter of the stepped portion.

6. The scroll compressor of claim 1, wherein a center axis of the receiving space is coaxial with a center axis of the discharge pipe.

7. The scroll compressor of claim 1, further comprising a mesh or an oil separation plate that is located at an inlet end of the discharge pipe.

8. The scroll compressor of claim 1, further comprising a flow passage separation unit that has a ring shape, that is located in a space between the drive motor and the compression unit, and that separates the space between the drive motor and the compression unit into a first space that communicates with the internal flow passage of the drive motor and a second space that communicates with the external flow passage of the drive motor.

9. A scroll compressor comprising:

a casing that defines an internal space;

an electric motor located in the internal space of the casing, the electric motor comprising a rotator and a rotation shaft;

a compression unit that is connected to the electric motor and that is configured to compress refrigerant based on rotation of the electric motor;

a discharge pipe that communicates with an upper portion of the internal space of the casing, that is spaced apart from the electric motor, and that is configured to discharge refrigerant from the compression unit to an outside of the casing;

an oil separation member that defines a receiving space recessed from an upper surface of the oil separation member, that is located on the rotator of the electric motor or the rotation shaft of the electric motor, and that is configured to separate oil from refrigerant based on rotation of the rotator; and a balance weight that connects the oil separation member to the rotator and that is offset from a center axis of the discharge pipe, wherein the oil separation member comprises:

a bottom portion that extends in a radial direction of the electric motor toward an inner circumferential surface of the casing, the bottom portion being spaced apart from a lower end of the discharge pipe and having a diameter greater than an outer diameter of the rotation shaft, and a side-wall portion that protrudes upward from an edge of the bottom portion in an axial direction of the electric motor and defines the receiving space with the bottom portion, the side-wall portion having a ring shape that surrounds the receiving space along a circumferential direction to block a radial end of the receiving space.

10. The scroll compressor of claim 9, wherein the lower end of the discharge pipe extends into the receiving space, and wherein the side-wall portion overlaps the lower end of the discharge pipe in the axial direction.

11. The scroll compressor of claim 9, further comprising a mesh that has a ring shape and that is located at the lower end of the discharge pipe, wherein at least a portion of the mesh overlaps the lower end of the discharge pipe in the axial direction.

12. The scroll compressor of claim 11, wherein the mesh is spaced apart from an outer circumferential surface of the lower end of the discharge pipe, and wherein the mesh surrounds the outer circumferential surface of the lower end of the discharge pipe.

13. The scroll compressor of claim 11, wherein the mesh extends further into the receiving space of the oil separation member than the lower end of the discharge pipe.

14. The scroll compressor of claim 9, further comprising an oil separation plate that has a ring shape, that is located at the lower end of the discharge pipe, and that is positioned within the receiving space of the oil separation member.

15. The scroll compressor of claim 14, wherein the oil separation plate is spaced apart from the bottom portion of the oil separation member in the axial direction.

16. A scroll compressor comprising:

a casing that defines an internal space;

a drive motor comprising:

a stator located in the internal space of the casing, and a rotator located radially inward of the stator and configured to rotate with respect to the stator, the rotator defining an internal flow passage and an external flow passage that passes through the drive motor in an axial direction of the drive motor;

a rotation shaft connected to the rotator and configured to rotate based on rotation of the rotator;

a compression unit comprising:

a first scroll located vertically below the drive motor, and a second scroll that is located inside of the first scroll, that is connected to the rotation shaft, and that is configured to define a compression chamber based on rotation relative to the first scroll, the compression unit being configured to compress refrigerant in the compression chamber and to discharge compressed refrigerant toward the internal space of the casing;

a discharge pipe that communicates with an upper portion of the internal space of the casing and that is located vertically above the drive motor;

a balance weight connected to the rotator; and an oil separation member that is located between the drive motor and the discharge pipe, that defines a receiving space recessed from an upper surface of the oil separation member, and that is configured to, based on centrifugal force, separate oil from refrigerant discharged from the compression unit, wherein the oil separation member comprises:

a bottom portion that is located at an end portion of the rotator or that is connected to a connection part that connects to the rotator, the bottom portion being spaced apart from the discharge pipe, and a side-wall portion that protrudes upward from an edge of the bottom portion and that extends vertically above the end portion of the discharge pipe, wherein the bottom portion and the side-wall portion define the receiving space of the oil separation member, and wherein the oil separation member is coupled to an upper surface of the balance weight, or the oil separation member and the balance weight are portions of a single body.

17. The scroll compressor of claim 16, wherein a height of the side-wall portion in the axial direction is greater than or equal to a distance between an upper surface of the bottom portion and a lower end of the discharge pipe.

18. The scroll compressor of claim 16, wherein a center axis of the receiving space is coaxial with a center axis of the discharge pipe.

19. The scroll compressor of claim 16, further comprising a flow passage separation unit that has a ring shape, that is located in a space between the drive motor and the compression unit, and that separates the space between the drive motor and the compression unit into a first space that communicates with the internal flow passage of the drive motor and a second space that communicates with the external flow passage of the drive motor.

* * * * *